US008532516B2

(12) United States Patent
Chosokabe

(10) Patent No.: US 8,532,516 B2
(45) Date of Patent: Sep. 10, 2013

(54) FIXING DEVICE, IMAGE FORMING APPARATUS, AND HEATING CONTROL METHOD

(75) Inventor: Kiriko Chosokabe, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 1069 days.

(21) Appl. No.: 12/098,184

(22) Filed: Apr. 4, 2008

(65) Prior Publication Data

US 2008/0253791 A1 Oct. 16, 2008

(30) Foreign Application Priority Data

Apr. 12, 2007 (JP) ..... 2007-104948
Mar. 4, 2008 (JP) ..... 2008-053778

(51) Int. Cl.
*G03G 15/20* (2006.01)

(52) U.S. Cl.
USPC ..... 399/70

(58) Field of Classification Search
USPC ..... 399/69, 70
See application file for complete search history.

(56) References Cited

U.S. PATENT DOCUMENTS

| | | | | |
|---|---|---|---|---|
| 5,907,743 | A | 5/1999 | Takahashi | |
| 6,034,790 | A | 3/2000 | Kamei et al. | |
| 2006/0051118 | A1 * | 3/2006 | Kaji et al. | 399/69 |

FOREIGN PATENT DOCUMENTS

| | | | |
|---|---|---|---|
| JP | 62-14215 | | 1/1987 |
| JP | 63-88586 | | 4/1988 |
| JP | 4-270336 | | 9/1992 |
| JP | 6-110141 | | 4/1994 |
| JP | 10-133504 | | 5/1998 |
| JP | 10-186908 | | 7/1998 |
| JP | 11161086 | A * | 6/1999 |
| JP | 2001-34345 | | 2/2001 |
| JP | 2001-265155 | | 9/2001 |
| JP | 3396122 | | 2/2003 |
| JP | 2005-176485 | | 6/2005 |

OTHER PUBLICATIONS

Extended European Search Report issued Oct. 20, 2010 in EP 08 25 1417.

* cited by examiner

*Primary Examiner* — David Gray
*Assistant Examiner* — Andrew Do
(74) *Attorney, Agent, or Firm* — Oblon, Spivak, McClelland, Maier & Neustadt, L.L.P.

(57) ABSTRACT

A heating unit is heated by supply of an alternate-current power. A heating control unit executes a phase control to supply the alternate-current power to the heating unit for an ON-width in at least a half-wave period of the alternate-current power. A storing unit stores therein parameters for calculating the ON width. The heating control unit calculates the ON width based on the parameters stored in the storing unit and executes the phase control using a calculated ON width.

6 Claims, 19 Drawing Sheets

| REGISTER SET VALUE | | | |
|---|---|---|---|
| NAME | SYMBOL | NUMERICAL VALUE | UNIT |
| POWER SUPPLY FREQUENCY | Fp | 50 | Hz |
| POWER SUPPLY HALF-WAVE | Th | 10 | ms |
| DUTY STEP | Ds | 5 | % |
| NUMBER OF STEPS | Ns | 5 | TIMES |

| REGISTER SET VALUE | | | |
|---|---|---|---|
| NAME | SYMBOL | NUMERICAL VALUE | UNIT |
| POWER SUPPLY FREQUENCY | Fp | 50 | Hz |
| POWER SUPPLY HALF-WAVE | Th | 10 | ms |
| DUTY STEP | Ds | 5 | % |
| NUMBER OF STEPS | Ns | 5 | TIMES |
| HALF-WAVE OFF | 1 | | |

| REGISTER SET VALUE | | | |
|---|---|---|---|
| NAME | SYMBOL | NUMERICAL VALUE | UNIT |
| POWER SUPPLY FREQUENCY | Fp | 50 | Hz |
| POWER SUPPLY HALF-WAVE | Th | 10 | ms |
| DUTY STEP | Ds | 5 | % |
| NUMBER OF REPEAT | Nr | 1 | TIMES |
| NUMBER OF STEPS | Ns | 5 | TIMES |

| REGISTER SET VALUE | | | |
|---|---|---|---|
| NAME | SYMBOL | NUMERICAL VALUE | UNIT |
| POWER SUPPLY FREQUENCY | Fp | 50 | Hz |
| POWER SUPPLY HALF-WAVE | Th | 10 | ms |
| FIRST DUTY | Df | 14 | % |
| DUTY STEP | Ds | 2 | % |
| NUMBER OF STEPS | Ns | 4 | TIMES |

| REGISTER SET VALUE | | | |
|---|---|---|---|
| NAME | SYMBOL | NUMERICAL VALUE | UNIT |
| POWER SUPPLY FREQUENCY | Fp | 50 | Hz |
| POWER SUPPLY HALF-WAVE | Th | 10 | ms |
| FIRST DUTY | Df | 14 | % |
| DUTY STEP | Ds | 2 | % |
| NUMBER OF REPEAT | Nr | 1 | TIMES |
| NUMBER OF STEPS | Ns | 4 | TIMES |

| REGISTER SET VALUE | | | |
|---|---|---|---|
| NAME | SYMBOL | NUMERICAL VALUE | UNIT |
| POWER SUPPLY FREQUENCY | Fp | 50 | Hz |
| POWER SUPPLY HALF-WAVE | Th | 10 | ms |
| FIRST DUTY | Df | 14 | % |
| NUMBER OF REPEAT | Nr | 7 | TIMES |

| REGISTER SET VALUE | | | |
|---|---|---|---|
| NAME | SYMBOL | NUMERICAL VALUE | UNIT |
| POWER SUPPLY FREQUENCY | Fp | 50 | Hz |
| POWER SUPPLY HALF-WAVE | Th | 10 | ms |
| PHASE CONTROL PERIOD | T | 100 | ms |
| LAST DUTY | Dl | 27 | % |
| DUTY STEP | Ds | 5 | % |
| NUMBER OF SOFT-START | N | 10 | TIMES |
| NUMBER OF STEPS | Ns | 9 | TIMES |

| REGISTER SET VALUE | | | |
|---|---|---|---|
| NAME | SYMBOL | NUMERICAL VALUE | UNIT |
| POWER SUPPLY FREQUENCY | Fp | 50 | Hz |
| POWER SUPPLY HALF-WAVE | Th | 10 | ms |
| PHASE CONTROL PERIOD | T | 100 | ms |
| LAST DUTY | Dl | 27 | % |
| FIRST DUTY | Df | 11 | % |
| DUTY STEP | Ds | 2 | % |
| NUMBER OF SOFT-START | N | 10 | TIMES |
| NUMBER OF STEPS | Ns | 9 | TIMES |

| REGISTER SET VALUE | | | |
|---|---|---|---|
| NAME | SYMBOL | NUMERICAL VALUE | UNIT |
| POWER SUPPLY FREQUENCY | Fp | 50 | Hz |
| POWER SUPPLY HALF-WAVE | Th | 10 | ms |
| PHASE CONTROL PERIOD | T | 100 | ms |
| LAST DUTY | Dl | 22 | % |
| FIRST DUTY | Df | 4 | % |
| DUTY STEP | Ds | 2 | % |
| NUMBER OF SOFT-START | N | 10 | TIMES |
| NUMBER OF STEPS | Ns | 9 | TIMES |

FIG. 32
| REGISTER SET VALUE | | | |
|---|---|---|---|
| NAME | SYMBOL | NUMERICAL VALUE | UNIT |
| POWER SUPPLY FREQUENCY | Fp | 50 | Hz |
| POWER SUPPLY HALF-WAVE | Th | 10 | ms |
| DUTY STEP | Ds | 5 | % |
| NUMBER OF STEPS | Ns | 5 | TIMES |
| ENERGIZATION START TIME | Ts | 5 | ms |
FIG. 33
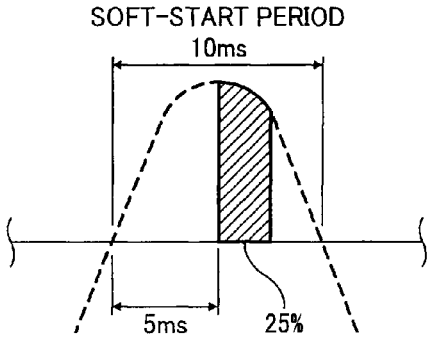
FIG. 34
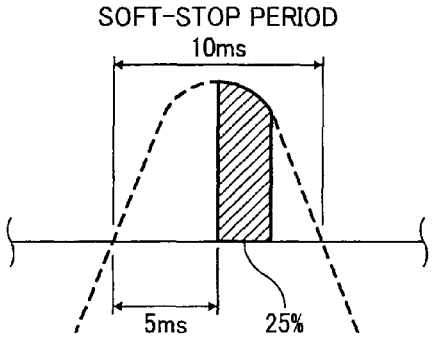

FIXING DEVICE, IMAGE FORMING APPARATUS, AND HEATING CONTROL METHOD

CROSS-REFERENCE TO RELATED APPLICATIONS

The present application claims priority to and incorporates by reference the entire contents of Japanese priority documents, 2007-104948 filed in Japan on Apr. 12, 2007 and 2008-053778 filed in Japan on Mar. 4, 2008.

BACKGROUND OF THE INVENTION

1. Field of the Invention

The present invention relates to a fixing device that executes phase control for AC power on heaters, an image forming apparatus including the fixing device, and a heating control method executed by the fixing device.

2. Description of the Related Art

In recent years, image forming apparatuses employing an electrophotographic process such as a copying machine, a printer, a facsimile, and a multi-function peripheral configured by combining these apparatuses include a scanner unit for scanning an image, an engine unit for forming a toner image corresponding to an image scanned by the scanner unit on transfer paper, and a fixing device for fixing the toner image on the transfer paper formed by the engine unit using a fixing roller and a pressure roller.

The fixing device causes heaters to generate heat with an AC voltage supplied from an AC power supply and heats the fixing roller using the heaters caused to generate heat. To keep the temperature of the fixing roller heated to specific temperature in a fixed range, the heaters repeat to be turned on and off at a fixed time interval.

In causing the heaters to generate heat with a supplied voltage, to control occurrence of a flicker and occurrence of a harmonic current, for example, Japanese Patent Application Laid-open No. 2005-176485 discloses a technology for executing phase control for an AC voltage.

However, in the technology in the past, ON widths in respective half-wave periods of the AC power subjected to the phase control are stored in a memory, the respective ON widths stored in the memory are read out, and the heaters are caused to generate heat based on the read-out respective ON widths. Therefore, an extremely large capacity of the memory for storing the ON widths is required.

SUMMARY OF THE INVENTION

It is an object of the present invention to at least partially solve the problems in the conventional technology.

According to an aspect of the present invention, there is provided a heating device including a heating unit that is heated by supply of an alternate-current power; a heating control unit that executes a phase control to supply the alternate-current power to the heating unit for an ON-width in at least a half-wave period of the alternate-current power; and a storing unit that stores therein parameters for calculating the ON width. The heating control unit calculates the ON width based on the parameters stored in the storing unit and executes the phase control using a calculated ON width.

Furthermore, according to another aspect of the present invention, there is provided an image forming apparatus including a fixing device for fixing a toner image on a recording medium. The fixing device includes a heating unit that is heated by supply of an alternate-current power, a heating control unit that executes a phase control to supply the alternate-current power to the heating unit for an ON-width in at least a half-wave period of the alternate-current power, and a storing unit that stores parameters for calculating the ON width. The heating control unit calculates the ON width based on the parameters stored in the storing unit and executes the phase control using a calculated ON width.

Moreover, according to still another aspect of the present invention, there is provided a heating control method performed in a fixing device. The heating control method includes heating a heating unit by supplying an alternate-current power; and executing a phase control to supply the alternate-current power to the heating unit for an ON-width in at least a half-wave period of the alternate-current power. The executing includes calculating the ON width based on parameters stored in a storing unit, and executing the phase control using a calculated ON width.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 32 is a table of register set values of an external memory according to a tenth embodiment of the present invention;

FIG. 33 is a diagram of a waveform of phase control in a soft-start period of heaters performed based on parameters according to the tenth embodiment; and FIG. 34 is a diagram of a waveform of phase control in a soft-stop period of the heaters performed based on the parameters according to the tenth embodiment.

DETAILED DESCRIPTION OF THE PREFERRED EMBODIMENTS

Exemplary embodiments of the present invention are explained in detail below with reference to the accompanying drawings. The present invention is not limited by the embodiments. Elements in the embodiments include elements easily arrived at by those skilled in the art and elements substantially identical therewith.

Figure 1:
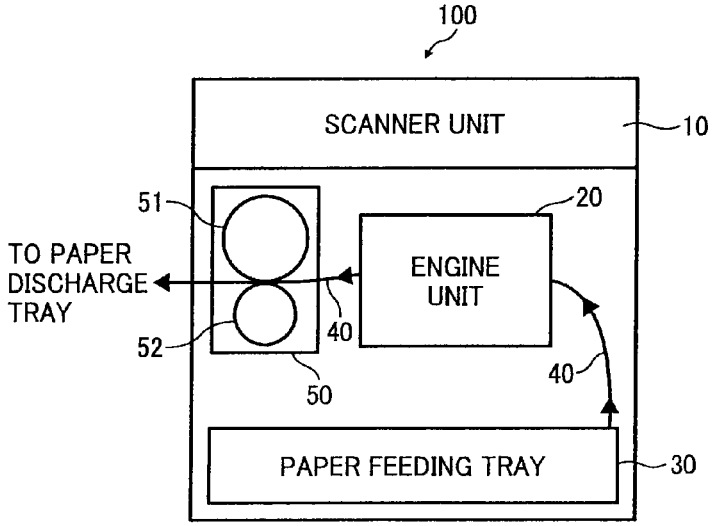
FIG. 1 is a diagram of the structure of an image forming apparatus according to a first embodiment of the present invention.

FIG. 1 is a diagram of the structure of an image forming apparatus 100 according to a first embodiment of the present invention. The image forming apparatus 100 according to the first embodiment includes, as shown in the figure, a scanner unit 10 for scanning an image, an engine unit 20 that applies predetermined processing to the image scanned by the scanner unit 10 and transfers a toner image corresponding to the image subjected to the processing onto transfer paper, a paper feeding tray 30 for storing the transfer paper, and a fixing device 50 for fixing the toner image transferred onto the transfer paper by the engine unit 20.

The scanner unit 10 scans and exposes an original to convert document information related to the original into an image signal and outputs the image signal to the engine unit 20.

When the image signal is output from the scanner unit 10, the engine unit 20 applies image processing such as color conversion and gradation correction to the image signal output from the scanner unit 10. The engine unit 20 forms an electrostatic latent image on an image bearing member (not shown) according to an image subjected to the image processing, deposits a toner on the formed electrostatic latent image to form a toner image, transfers the formed toner image onto transfer paper conveyed from the paper feeding tray 30 through a conveying path 40, and forwards the transfer paper to the fixing device 50.

The fixing device 50 fixes the toner image transferred on the transfer paper with heat generated by a cylindrical fixing roller 51 and pressure generated by a pressure roller 52 and discharges the transfer paper to a paper discharge tray (not shown).

Figure 2:
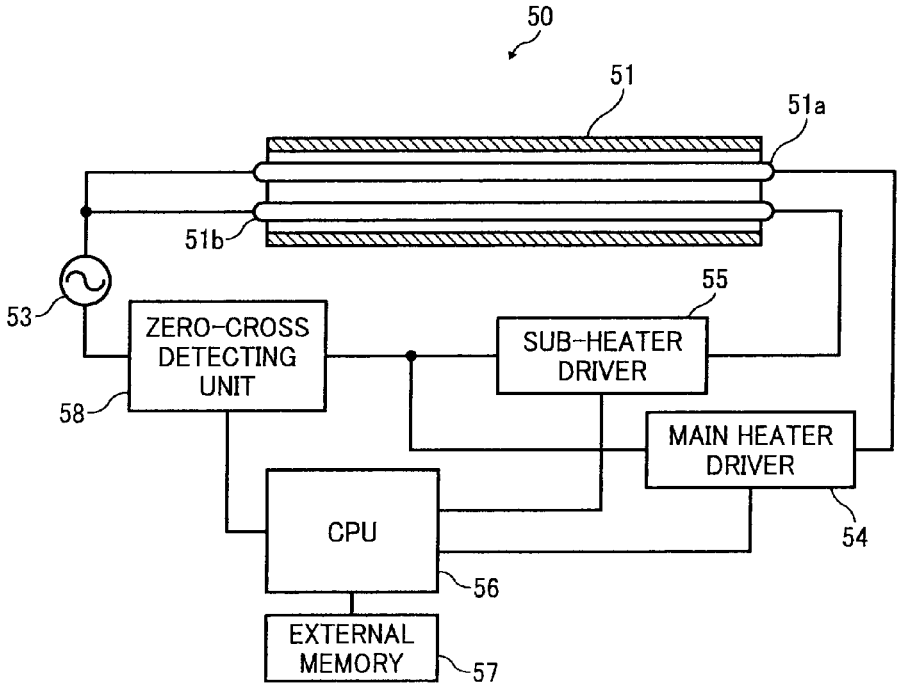
FIG. 2 is a diagram of the structure of a fixing device according to the first embodiment.

FIG. 2 is a diagram of the structure of the fixing device 50 according to the first embodiment. The fixing device 50 according to the first embodiment includes, as shown in the figure, the fixing roller 51 incorporating a main heater 51*a* and a sub-heater 51*b*, an AC power supply 53 that supplies an AC voltage, a main heater driver 54 that applies the AC voltage supplied from the AC power supply 53 to the main heater 51*a*, a sub-heater driver 55 that applies the AC voltage supplied from the AC power supply 53 to the sub-heater 51*b*, a central processing unit (CPU) 56 that controls turn-on states of the heaters by the main heater driver 54 and the sub-heater driver 55, an external memory 57 that stores various programs to be executed in the CPU 56 and various data, and a zero-cross detecting unit 58 that detects timing when a signal of the AC voltage supplied from the AC power supply 53 crosses 0V.

As shown in the figure, the fixing roller 51 includes the main heater 51*a* and the sub-heater 51*b* and is connected to the main heater driver 54, the sub-heater driver 55, and the AC power supply 53. The fixing roller 51 melts, with heat, the toner image transferred on the transfer paper conveyed from the engine unit 20 and embeds the toner image in fibers of the transfer paper and fixes the toner image.

The main heater 51*a* and the sub-heater 51*b* as heating means generate heat according to the AC voltage supplied from the AC power supply 53 to thereby heat the fixing roller 51. When the main heater driver 54 and the sub-heater driver 55 are turned on, the main heater 51*a* and the sub-heater 51*b* are connected to the AC power supply 53 to thereby generate heat. When it is unnecessary to specifically distinguish the main heater 51*a* and the sub-heater 51*b*, the main heater 51*a* and the sub-heater 51*b* are referred to as "heaters" in the following explanation.

The AC power supply 53 is connected to the fixing roller 51 and the zero-cross detecting unit 58 and supplies an AC voltage to the heaters.

The main heater driver 54 as heating control means applies the AC voltage supplied from the AC power supply 53 to the main heater 51*a* with according to the control by the CPU 56. The sub-heater driver 55 applies the AC voltage supplied from the AC power supply 53 to the sub-heater 51*b* according to the control by the CPU 56. When it is unnecessary to specifically distinguish the main heater driver 54 and the sub-heater driver 55, the main heater driver 54 and the sub-heater driver 55 are referred to as "drivers" in the following explanation.

The CPU 56 as heating control means calculates ON widths in respective half-wave period of an AC voltage based on respective parameters set in a register in the external memory 57. The CPU 56 controls the turn-on states of the drivers based on the calculated ON widths. The CPU 56 controls the turn-on start time of the drivers based on a zero-cross detected by the zero-cross detecting unit 58. The heaters are heated by AC power supplied at the ON widths.

A state in which the heaters are completely off means a state in which the ON widths in the respective half-wave periods are zero and the AC power is not supplied to the heaters at all. The period is referred to as a complete-off period. A state in which the heaters are fully on means a state in which the ON widths are the same as the respective half-wave periods and the AC power is always supplied to the heaters. The period is referred to as a full-on period.

The heaters are gradually turned on from the completely off state and are finally fully turned on. This is referred to as "soft-start". In a period of soft-start (a soft-start period), the AC power is supplied to the heaters at an ON width determined for each of the half-wave periods, i.e., phase control is performed. The heaters are gradually turned off from the full-on state and are finally completely turned off. This is referred to as "soft-stop". In a period of soft-stop (a soft-stop period), the AC power is supplied to the heaters at an ON width determined for each of the half-wave periods, i.e., phase control is performed. The heaters repeat a cycle of complete-off, soft-start, full-on, soft-stop, and complete-off to perform fine adjustment of the temperature of the fixing roller 51.

The external memory 57 as storing means stores a register in which respective parameters are set.

When the zero-cross detecting unit 58 detects timing when a signal of an AC voltage supplied from the AC power supply 53 crosses 0V (hereinafter, "zero-cross"), the zero-cross detecting unit 58 outputs a zero-cross detection signal to the CPU 56.

Figures 3, 4:
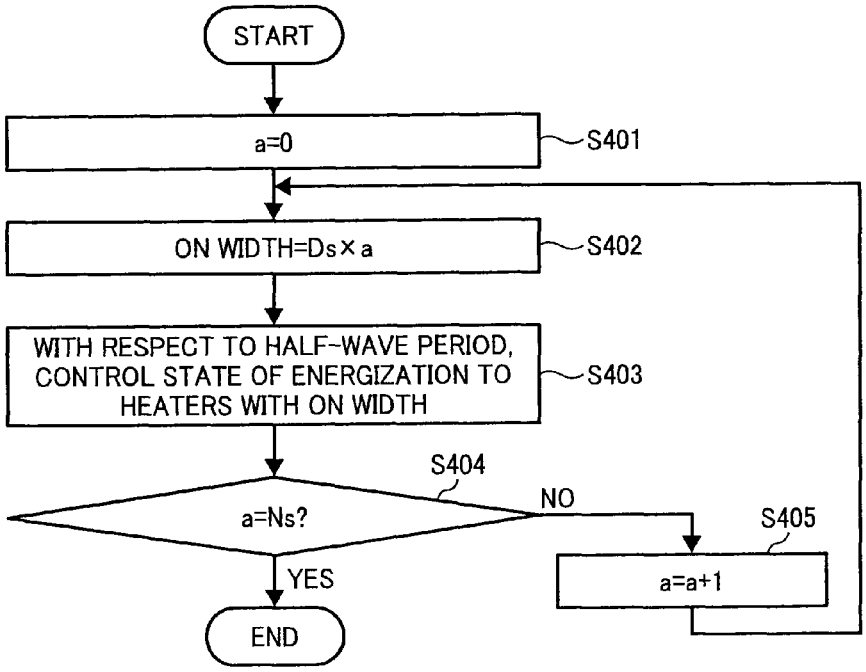
FIG. 3 is a table of register set values of an external memory according to the first embodiment.
FIG. 4 is a flowchart for explaining a phase control method in a soft-start period of heaters according to the first embodiment.

The respective parameters set in the register in the external memory 57 according to the first embodiment are explained referring to FIG. 3. FIG. 3 is a table of register set values of the external memory 57 according to the first embodiment.

In the external memory 57 according to the first embodiment, as shown in the figure, a power supply frequency Fp, a power supply half-wave Th, a duty step Ds, and the number of steps Ns are set as parameters. Set values of the respective parameters are not limited to those shown in the figure. The set values of the respective parameters can be easily changed for each delivery destination of the image forming apparatus 100. The set values can be easily changed even after the delivery of the image forming apparatus 100.

The power supply frequency Fp defines a frequency of the AC voltage supplied from the AC power supply 53. In this embodiment, as shown in the figure, a set value of the power supply frequency Fp is 50 hertz. The power supply half-wave Th defines a period of a half-wave of the AC voltage supplied from the AC power supply 53. In this embodiment, as shown in the figure, a set value of the power supply half-wave Th is 10 milliseconds. Usually, as the power supply frequency Fp and the power supply half-wave Th, values measured at the start of the image forming apparatus 100 are stored.

The duty step Ds defines an amount of increase in an ON width. In this embodiment, as shown in the figure, a set value of the duty step Ds is 5%.

The number of steps Ns defines the number of half-wave periods to which the duty step Ds is added. In this embodiment, as shown in the figure, a set value of the number of steps Ns is five times.

In both the soft-start period and the soft-stop period, the CPU 56 calculates ON widths in the respective half-wave periods using the parameters set in the register in the external memory 57.

FIG. 4 is a flowchart of a phase control method in the soft-start period of the heaters according to the first embodiment.

First, the CPU 56 determines the start of the soft-start for the completely-off heaters and sets one register value (a register value "a") of the register in the external memory 57 to zero (Step S401). The CPU 56 calculates an ON width (Step S402). The ON width is calculated by (duty step Ds)×(register value "a"). The CPU 56 controls, with respect to a first half-wave period after the start of the soft-start, the turn-on states of the heaters with the calculated ON width (Step S403).

Subsequently, the CPU 56 judges whether the register value "a" is the same as the set number of steps Ns (Step S404). When the CPU 56 judges that the register value "a" and the set number of steps Ns are the same ("Yes" at Step S404), the CPU 56 finishes the soft-start and shifts to the full-on. When the CPU 56 judges that the register value "a" and the set number of steps Ns are not the same ("No" at Step S404), the CPU 56 adds 1 to the register value "a" (Step S405). The CPU 56 returns to Step S402 and repeats the processing at Step S402 and subsequent steps for each of half-wave periods.

Figure 5:
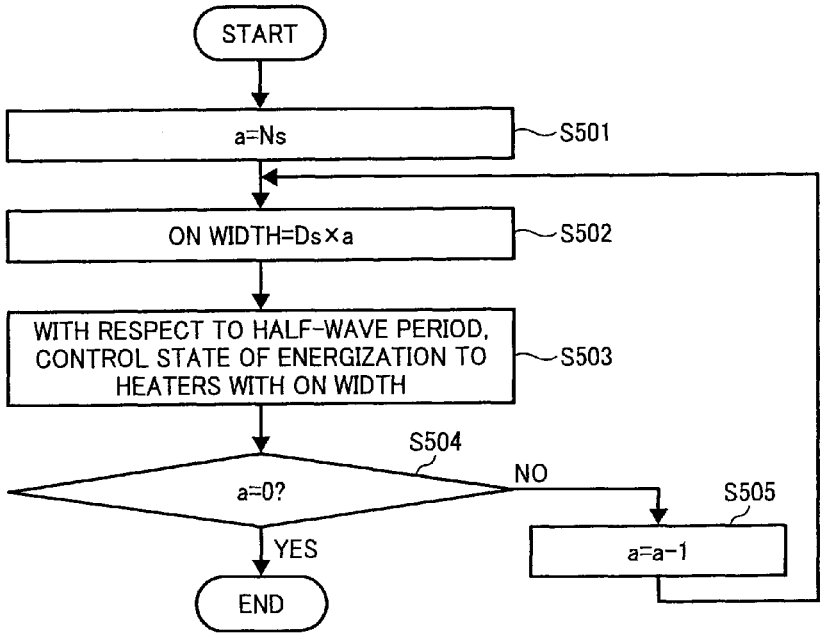
FIG. 5 is a flowchart for explaining a phase control method in a soft-stop period of the heaters according to the first embodiment.

FIG. 5 is a flowchart for explaining a phase control method in the soft-stop period.

First, the CPU 56 determines the start of the soft-stop for the fully-on heaters and sets one register value (a register value "a") of the register in the external memory 57 as the number of steps Ns (Step S501). The CPU 56 calculates an ON width (Step S502). The ON width is calculated by (duty step Ds)×(register value "a"). The CPU 56 controls, with respect to a first half-wave period after the start of the soft-stop, the turn-on states of the heaters with the calculated ON width (Step S503).

Subsequently, the CPU 56 judges whether the register value "a" is zero (Step S504). When the CPU 56 judges that the register value "a" is zero ("Yes" at Step S504), the CPU 56 finishes the soft-stop and shifts to the complete-off. When the CPU 56 judges that the register value "a" is not zero ("No" at Step S504), the CPU 56 subtracts "1" from the register value "a" (Step S505). The CPU 56 returns to Step S502 and repeats the processing at Step S502 and subsequent steps for each of half-wave periods.

Figure 6:
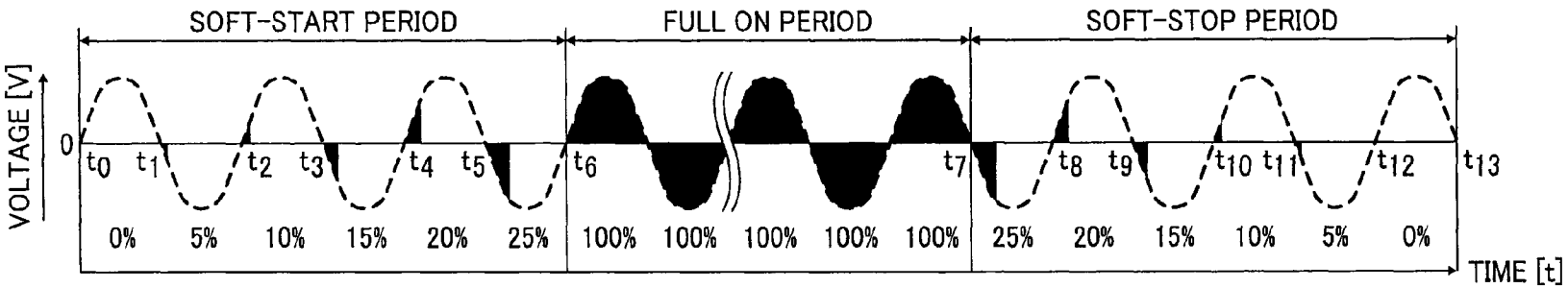
FIG. 6 is a diagram of a waveform of phase control performed based on parameters according to the first embodiment.

FIG. 6 is a diagram of a waveform of phase control performed based on the parameters according to the first embodiment.

First, the CPU 56 sets a percentage of an ON width in a first half-wave period ($t_0$ to $t_1$) of a soft-start period ($t_0$ to $t_6$) to 0% and controls the turn-on states of the heaters ($t_0$ to $t_1$).

Subsequently, the CPU 56 calculates a value obtained by adding the duty step Ds to the ON width in the first half-wave period as an ON width and controls the turn-on states of the heaters based on the calculated ON width (5%) ($t_1$ to $t_2$).

The CPU 56 calculates, according to a control method in the period $t_1$ to $t_2$, ON widths in respective half-wave periods until the set value (five times) of the number of steps Ns is reached and controls the turn-on states of the heaters based on the calculated ON widths ($t_2$ to $t_6$). The CPU 56 records an ON width (25%) in a last half-wave period in the soft-start period in the external memory 57.

The CPU 56 controls, in the soft-start period, the drivers to start applying the voltages at the zero-cross time detected by the zero-cross detecting unit 58.

When the soft-start period ends, the CPU 56 shifts to a full-on period ($t_6$ to $t_7$) in which the heaters are fully on. In the full-on period, a percentage of ON widths in respective half-wave period is 100%.

When the full-on period ends, the CPU 56 shifts to a soft-stop period ($t_7$ to $t_{13}$). The CPU 56 sets the percentage (25%) of the ON width in the last half-wave period of the soft-start period, which is recorded in the external memory 57, or a percentage (25%) of an ON width, which is calculated from an integrated value of the duty step Ds (5%) and the number of steps (five times), as an ON width in a first half-wave period of the soft-stop period and controls the turn-on states of the heaters with the ON width ($t_7$ to $t_8$).

Subsequently, the CPU 56 controls the turn-on states of the heaters based on a value (20%) obtained by subtracting the duty step Ds from the ON width in the first half-wave period ($t_7$ to $t_8$) ($t_8$ to $t_9$).

The CPU 56 calculates, according to a control method in the period $t_8$ to $t_9$, ON widths in respective half-wave periods until the set value (five times) of the number of steps Ns is reached and controls the turn-on states of the heaters based on the calculated ON widths ($t_9$ to $t_{13}$).

When the soft-stop period ends, the heaters are completely turned off. In a complete-off period, a percentage of ON widths in respective half-wave periods is 0%.

In the first embodiment, the ON width in the first half-wave period of the soft-start period is set to 0%. However, the present invention is not limited to this. For example, the duty step Ds can be set as the ON width in the first half-wave period of the soft-start period.

In the first embodiment, the common parameters are used to calculate ON widths in the respective half-wave periods of the soft-start period and ON widths in the respective half-wave periods of the soft-stop period. However, it is also possible that parameters peculiar to the respective periods are set in the register in the external memory 57 and ON widths in the respective half-wave periods of the soft-stop period are calculated by the CPU 56 based on the parameters peculiar to the soft-stop period.

As explained above, with the fixing device 50 according to the first embodiment, the duty step Ds and the number of steps Ns are set in the register in the external memory 57 as the parameters for calculating an ON width, ON widths in the respective half-wave periods of the soft-start period and the soft-stop period are calculated based on the parameters, and the turn-on states of the heaters is controlled based on the calculated ON widths. Therefore, it is possible to execute phase control for AC power while reducing a size of the register for calculating an ON width.

With the fixing device 50 according to the first embodiment, in the soft-start period, when zero-cross of the AC voltage of the AC power supply 53 is detected by the zero-cross detecting unit 58, the drivers are controlled by the CPU 56 to start applying the voltages to the heaters. Therefore, it is possible to prevent voltage fluctuation of the AC power supply 53 and failure of the heaters due to a rush current to the heaters. In the shift from the soft-start period to the full-on period, it is possible to provide an extinguishing period of the heaters and smooth the shift from the soft-start period to the full-on period.

An image forming apparatus 100 according to a second embodiment of the present invention is explained. In the explanation of the second embodiment, the repetition of the explanation of the image forming apparatus 100 according to the first embodiment may be omitted.

Figures 7, 8:
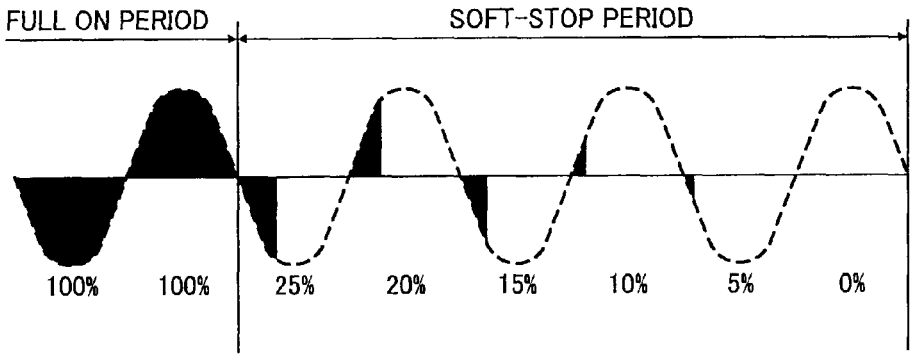
FIG. 7 is a diagram of a state of shift from a full-on period to a soft-stop period in the first embodiment.
FIG. 8 is a table of register set values of an external memory according to a second embodiment of the present invention.

In the first embodiment, in the soft-stop period, the turn-on states of the heaters are started at the zero-cross time detected by the zero-cross detecting unit 58. FIG. 7 is a diagram of a state of shift from the full-on period to the soft-stop period in the first embodiment. In the first embodiment, as shown in FIG. 7, in the shift from the full-on period to the soft-stop period, the heaters continue to be on by the ON width (25%) even in the first half-wave period at the start of the soft-stop period.

On the other hand, in the second embodiment, in the shift from the full-on period to the soft-stop period, the turn-on states of the heaters is stopped in the first half-wave period at the start of the soft-stop period and, then, the drivers are controlled to apply the voltages to the heaters.

FIG. 8 is a table of resister set values of the external memory 57 according to the second embodiment.

In the external memory 57 according to the second embodiment, as shown in the figure, the power supply frequency Fp, the power supply half-wave Th, the duty step Ds, the number of steps Ns, and half-wave OFF are set as parameters.

The half-wave OFF defines whether to start applying the voltages to the heaters in a first half-wave period at the start of a soft-stop period. When 1 is set in the half-wave OFF (when a flag is set), the CPU 56 stops applying the voltages to the heaters in the first half-wave period at the start of the soft-stop period. When zero is set in the half-wave OFF (when a flag is not set), the CPU 56 starts applying the voltages to the heaters from the first half-wave period at the start of the soft-stop period.

Figure 9:
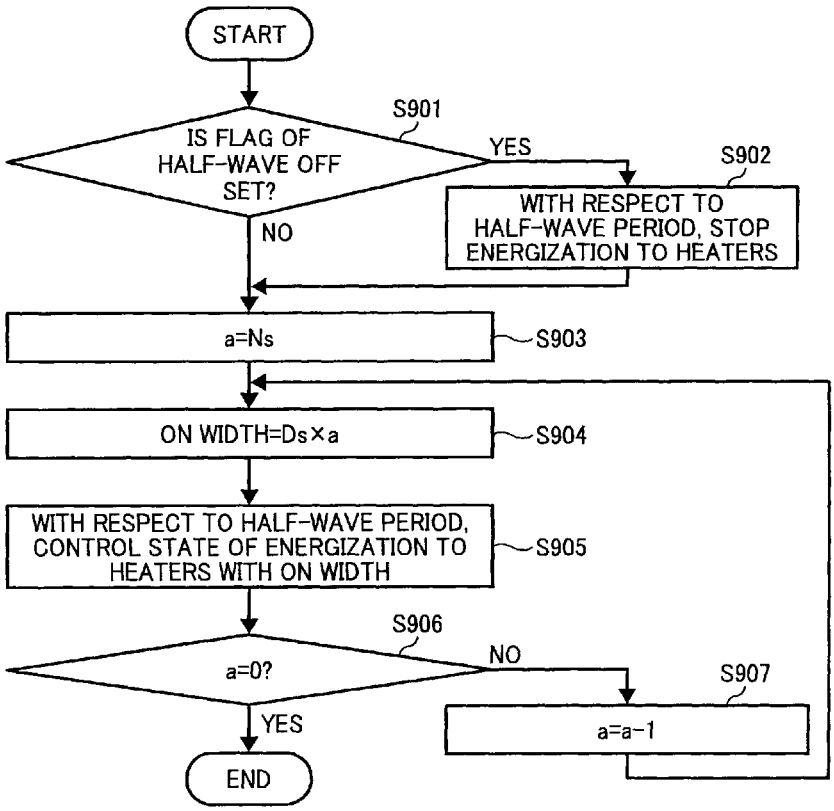
FIG. 9 is a flowchart for explaining a phase control method in a soft-stop period of heaters according to the second embodiment.

FIG. 9 is a flowchart for explaining a phase control method in the soft-stop period of the heaters.

First, the CPU 56 determines the start of the soft-stop for the fully-on heaters and judges whether a flag is set in the register of the half-wave OFF in the external memory 57 (Step S901). When the CPU 56 judges that a flag is set in the register of the half-wave OFF in the external memory 57 ("Yes" at Step S901), the CPU 56 stops applying the voltages to the heaters in the first half-wave period after the start of the soft-stop (Step S902). The CPU 56 proceeds to Step S903. When the CPU 56 judges that a flag is not set in the register of the half-wave OFF in the external memory 57 ("No" at Step S901), the CPU 56 directly proceeds to Step S903.

At Step S903, the CPU 56 sets one register value (a register value "a") of the register in the external memory 57 as the number of steps Ns. The CPU 56 calculates an ON width (Step S904). The ON width is calculated by (duty step Ds)× (register value "a"). The CPU 56 controls, with respect to the half-wave period, the turn-on states of the heaters with the calculated ON width (Step S905).

Subsequently, the CPU 56 judges whether the register value "a" is zero (Step S906). When the CPU 56 judges that the register value "a" is zero ("Yes" at Step S906), the CPU 56 finishes the soft-stop and shifts to the complete-off. When the CPU 56 judges that the register value "a" is not zero ("No" at Step S906), the CPU 56 subtracts "1" from the register value "a" (Step S907). The CPU 56 returns to Step S904 and repeats the processing at Step S904 and subsequent steps for each of half-wave periods.

Figure 10:
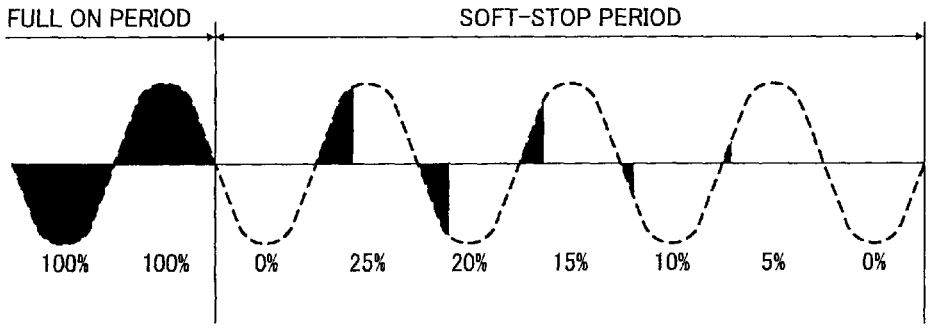
FIG. 10 is a diagram of a state of shift from a full-on period to a soft-stop period in the second embodiment.

FIG. 10 is a diagram of a state of shift from a full-on period to a soft-stop period in the second embodiment. It is seen from the figure that, in the shift from the full-on period to the soft-stop period, applying the voltages to the heaters is not performed in the first half-wave period at the start of the soft-stop period, the heaters are on by an ON width (25%) in the next half-wave period, and, thereafter, normal soft-stop is performed.

As explained above, with the fixing device 50 according to the first embodiment, the drivers are controlled by the CPU 56 not to applies the voltages to the heaters in the first half-wave period after the start of the soft-stop period and, then, start applying the voltages to the heaters. Therefore, in the shift from the full-on period to the soft-stop period, it is possible to provide an extinguishing period of the heaters and smoothly start phase control in the soft-stop period.

An image forming apparatus 100 according to a third embodiment of the present invention is explained. In the explanation of the third embodiment, the repetition of the explanation of the image forming apparatus 100 according to the first and second embodiments may be omitted.

In the first embodiment, the duty step Ds and the number of steps Ns are set in the register in the external memory 57 as the parameters for calculating an ON width. The ON width is calculated based on the parameters.

On the other hand, in the third embodiment, the duty step Ds, the number of repetitions Nr, and the number of steps Ns are set in the register as the parameters for calculating an ON width. The ON width is calculated based on the parameters.

Figures 11, 12:
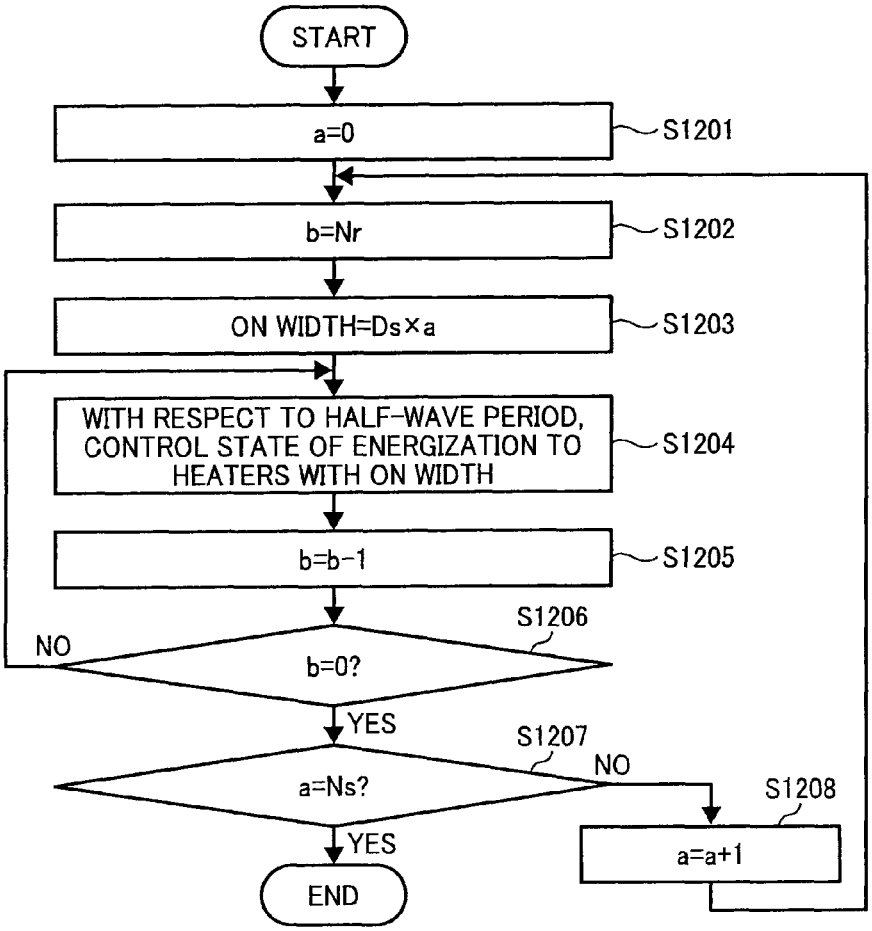
FIG. 11 is a table of register set values of an external memory according to a third embodiment of the present invention.
FIG. 12 is a flowchart for explaining a phase control method in a soft-start period of heaters according to the third embodiment.

FIG. 11 is a table of register set values of the external memory 57 according to the third embodiment. In the external memory 57 according to the third embodiment, as shown in the figure, the power supply frequency Fp, the power supply half-wave Th, the duty step Ds, the number of repetitions Nr, and the number of steps Ns are set as parameters.

The number of repetitions Nr defines the number of repetitions of the half-wave period of the ON width same as the calculated ON width.

FIG. 12 is a flowchart for explaining a phase control method in a soft-start period of the heaters according to the third embodiment.

First, the CPU 56 determines the start of the soft-start for the completely-off heaters and sets one register value (a register value "a") of the register in the external memory 57 to zero (Step S1201). The CPU 56 sets another register value (a register value "b") of the register in the external memory 57 as the number of repetitions Nr (Step S1202). The CPU 56 calculates an ON width (Step S1203). The ON width is calculated by (duty step Ds)×(register value "a"). The CPU 56 controls, with respect to a first half-wave period after the start of the soft-start, the turn-on states of the heaters with the calculated ON width (Step S1204).

Subsequently, the CPU 56 subtracts "1" from the register value "b" (Step S1205) and judges whether the register value "b" after subtracting "1" is zero (Step S1206). When the CPU 56 judges that the register value "b" is not zero ("No" at Step S1206), the CPU 56 returns to Step S1204 and repeats the processing at Step S1204 and subsequent steps for each of half-wave periods.

When the CPU 56 judges that the register value "b" is zero ("Yes" at Step S1206), the CPU 56 further judges whether the register value "a" and the set number of steps Ns are the same (Step S1207). When the CPU 56 judges that the register value "a" and the set number of steps Ns are the same ("Yes" at Step S1207), the CPU 56 starts the soft-start and shifts to the full-on. When the CPU 56 judges that the register value "a" and the set number of steps Ns are not the same ("No" at Step S1207), the CPU 56 adds 1 to the register value "a" (Step S1208). The CPU 56 returns to Step S1202 and repeats the processing at Step S1202 and subsequent steps for each of half-wave periods.

Figure 13:
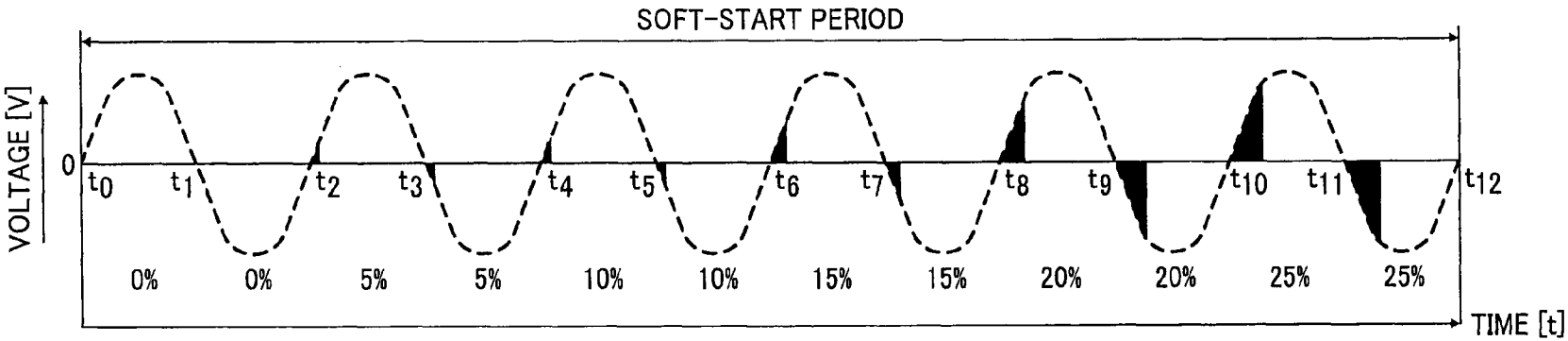
FIG. 13 is a diagram of a waveform of phase control performed based on parameters according to the third embodiment.

FIG. 13 is a diagram of a waveform of phase control performed based on the parameters according to the third embodiment. As shown in FIG. 11, it is assumed that a set value of the duty step Ds is 5%, a set value of the number of repetitions Nr is once, and a set value of the number of steps Ns is five times.

First, the CPU 56 sets the duty step Ds as an ON width (0%) in a first half-wave period of a soft-start period ($t_0$ to $t_{10}$) and controls the turn-on states of the heaters ($t_0$ to $t_1$). The CPU 56 executes an operation same as that in the period $t_0$ to $t_1$ for the number of repetitions Nr ($t_1$ to $t_2$).

Subsequently, the CPU 56 calculates a value obtained by adding the duty step Ds to the ON width in the first half-wave period as an ON width and controls the turn-on states of the heaters based on the calculated ON width (5%) ($t_2$ to $t_3$) The CPU 56 executes an operation same as that in the period $t_2$ to $t_3$ for the number of repetitions ($t_3$ to $t_4$).

The CPU 56 calculates values each obtained by adding the duty step Ds to the ON width in the first half-wave period as ON widths until the set value (five times) of the number of steps Ns is reached. The CPU 56 controls the turn-on states of the heaters based on the calculated ON widths. The CPU 56 further controls the turn-on states of the heaters based on the calculated ON widths for the number of repetitions Nr ($t_4$ to $t_{12}$).

A phase control method in a soft-stop period is the same as the method according to the first embodiment. Therefore, explanation of the phase control method is omitted.

In the third embodiment, the ON width in the first half-wave period of the soft-start period is set to 0%. However, the present invention is not limited to this. For example, the duty step Ds can be set as the ON width in the first half-wave period of the soft-start period.

As explained above, with the fixing device 50 according to the third embodiment, the duty step Ds, the number of repetitions Nr, and the number of steps Ns are set in the register in the external memory 57 as the parameters for calculating an ON width, ON widths in the respective half-wave periods of the soft-start period are calculated based on the parameters, and the turn-on states of the heaters is controlled based on the calculated ON widths. Therefore, it is possible to execute phase control with a high degree of freedom while reducing a size of the register for calculating an ON width.

An image forming apparatus 100 according to a fourth embodiment of the present invention is explained. In the explanation of the fourth embodiment, the repetition of the explanation of the image forming apparatus 100 according to the first to third embodiments may be omitted.

In the first embodiment, the duty step Ds and the number of steps Ns are set in the register in the external memory 57 as the parameters for calculating an ON width. The ON width is calculated based on the parameters.

On the other hand, in the fourth embodiment, a first duty Df, the duty step Ds, and the number of steps Ns are set in the register as parameters for calculating an ON width. The ON width is calculated based on the parameters.

Figures 14, 15:
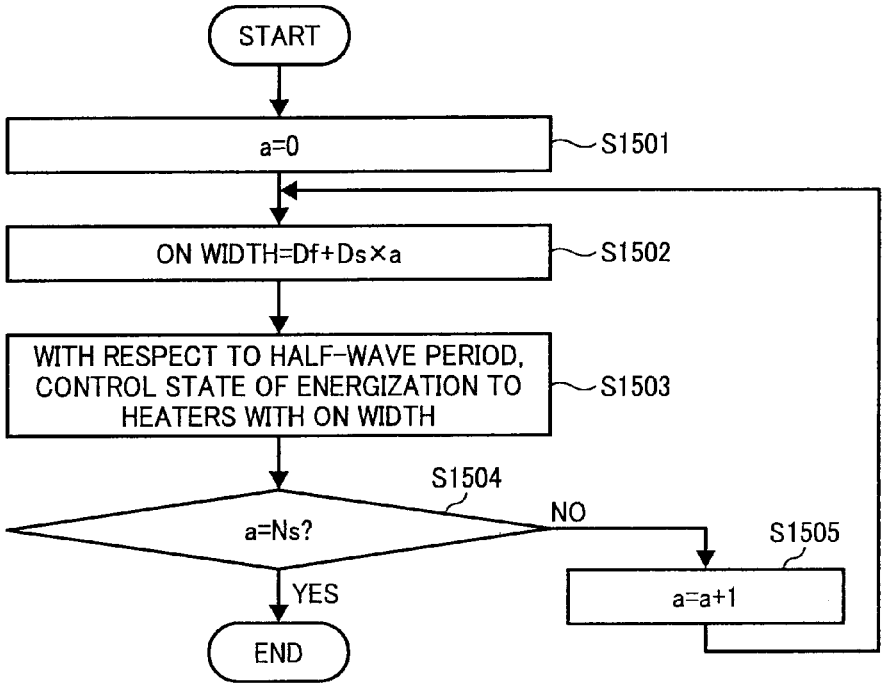
FIG. 14 is a table of register set values of an external memory according to a fourth embodiment of the present invention.
FIG. 15 is a flowchart for explaining a phase control method in a soft-start period of heaters according to the fourth embodiment.

FIG. 14 is a table of register set values of the external memory 57 according to the fourth embodiment. As shown in the figure, the power supply frequency Fp, the power supply half-wave Th, the first duty Df, the duty step Ds, and the number of steps Ns are defined as parameters in the external memory 57 according to the fourth embodiment.

The first duty DF defines an ON width in a first half-wave period of a soft-start period.

FIG. 15 is a flowchart for explaining a phase control method in the soft-start period of the heaters.

First, the CPU 56 determines the start of the soft-start for the completely-off heaters and sets one register value (a register value "a") of the register in the external memory 57 to zero (Step S1501). The CPU 56 calculates an ON width (Step S1502). The ON width is calculated by (first duty Df)+(duty step Ds)×(register value "a"). The CPU 56 controls, with respect to a first half-wave period after the start of the soft-start, the turn-on states of the heaters with the calculated ON width (Step S1503).

Subsequently, the CPU 56 judges whether the register value "a" and the set number of steps Ns are the same (Step S1504). When the CPU 56 judges that the register value "a" and the set number of steps Ns are the same ("Yes" at Step S1504), the CPU 56 finishes the soft-start and shifts to the full-on. When the CPU 56 judges that the register value "a" and the set number of steps Ns are not the same ("No" at Step S1504), the CPU 56 adds 1 to the register value "a" (Step S1505). The CPU 56 returns to Step S1502 and repeats the processing at Step S1502 and subsequent steps for each of half-wave periods.

Figures 16, 17:
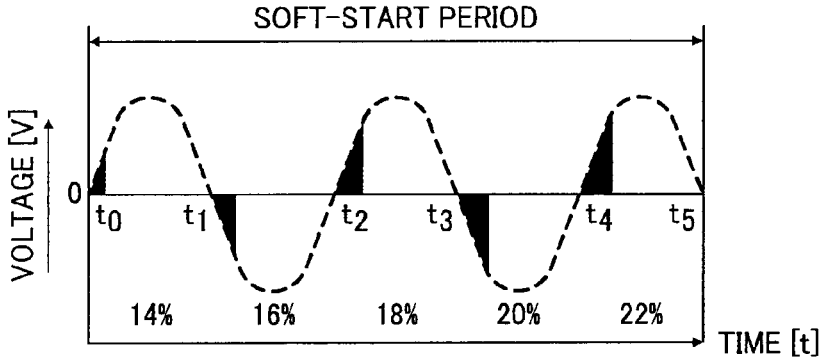
FIG. 16 is a diagram of a waveform of phase control performed based on parameters according to the fourth embodiment.
FIG. 17 is a table of register set values of an external memory according to a fifth embodiment of the present invention.

FIG. 16 is a diagram of a waveform of phase control performed based on the parameters according to the fourth embodiment. As shown in FIG. 14, it is assumed that a set value of the first duty Df is 14%, a set value of the duty step Ds is 2%, and a set value of the number of steps Ns is four times.

First, the CPU 56 sets the first duty Df as an ON width (14%) in a first half-wave period ($t_0$ to $t_1$) of a soft-start period ($t_0$ to $t_5$) and controls the turn-on states of the heaters ($t_0$ to $t_1$).

Subsequently, the CPU 56 calculates a value obtained by adding the duty step Ds to the ON width in the first half-wave period as an ON width and controls the turn-on states of the heaters based on the calculated ON width (16%) ($t_1$ to $t_2$).

The CPU 56 calculates, according to a control method in the period $t_1$ to $t_2$, ON widths in the respective half-wave periods until the set value (four times) of the number of steps Ns is reached and controls the turn-on states of the heaters based on the calculated ON widths ($t_2$ to $t_5$).

An ON width in a last half-wave period of the soft-start period can be calculated from the following equation as described above:

$$\text{On width (\%)} = \text{first duty } Df + \text{duty step } Ds \times \text{number of steps } Ns$$

Explanation of a phase control method in a soft-stop period is omitted.

As explained above, with the fixing device 50 according to the fourth embodiment, the first duty Df, the duty step Ds, and the number of steps Ns are set in the register in the external memory 57 as the parameters for calculating an ON width, ON widths in the respective half-wave periods of the soft-start period are calculated based on the parameters, and the turn-on states of the heaters is controlled based on the calculated ON widths. Therefore, it is possible to execute phase control with a high degree of freedom while reducing a size of the register for calculating an ON width.

With the fixing device 50 according to the fourth embodiment, the first duty Df that defines an ON width in the first half-wave period of the soft-start period is set in the register, an ON width in the first half-wave period is calculated based on the set first duty Df, and the turn-on states of the heaters is controlled based on the calculated ON width. Therefore, even when the zero-cross detecting unit 58 with low zero-cross detection accuracy is used and a zero-cross point deviates, it is possible to control the turn-on states of the heaters with a fixed ON width in the first half-wave period. This makes it possible to turn on the heaters as defined by specifications.

An image forming apparatus 100 according to a fifth embodiment of the present invention is explained. In the explanation of the fifth embodiment, the repetition of the explanation of the image forming apparatus 100 according to the first to fourth embodiments may be omitted.

In the fourth embodiment, the first duty Df, the duty step Ds, and the number of steps Ns are set in the register in the external memory 57 as the parameters for calculating an ON width. The ON width is calculated based on the parameters.

On the other hand, in the fifth embodiment, the first duty Df, the duty step Ds, the number of repetitions Nr, and the number of steps Ns are set in the register as the parameters for calculating an ON width. The ON width is calculated based on the parameters.

FIG. 17 is a table of register set values of the external memory 57 according to the fifth embodiment. In the external memory 57 according to the fifth embodiment, as shown in the figure, the power supply frequency Fp, the power supply half-wave Th, the first duty DF, the duty step Ds, the number of repetitions Nr, and the number of steps Ns are set as parameters.

Figure 18:
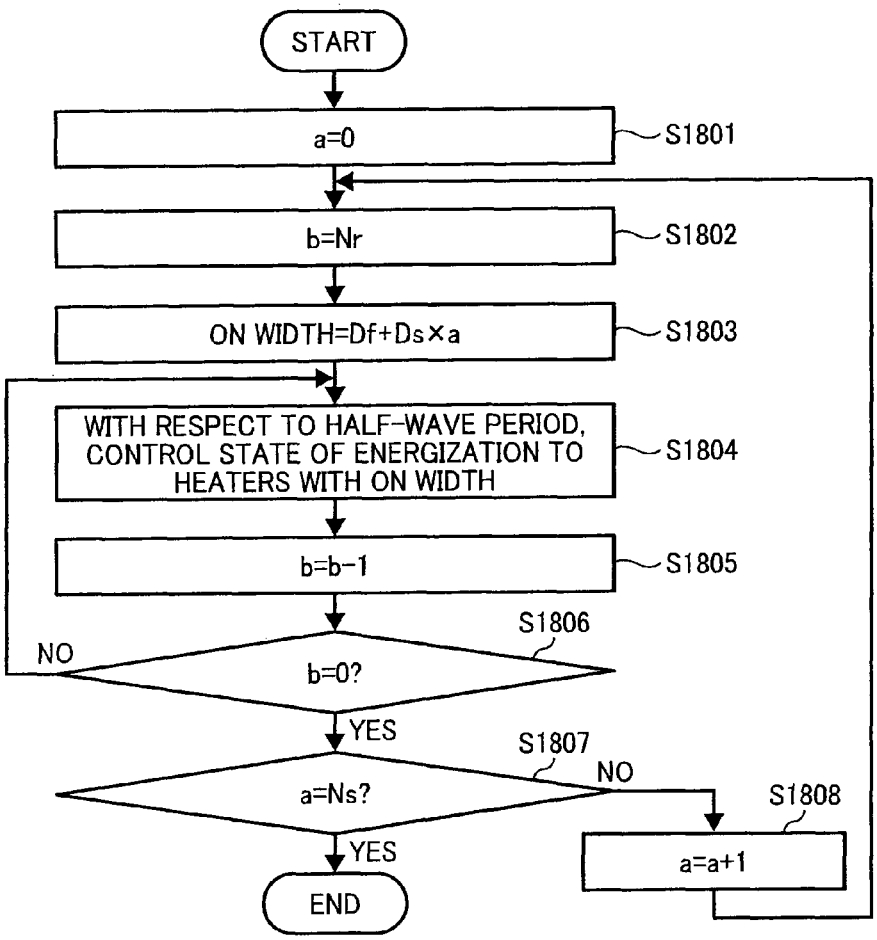
FIG. 18 is a flowchart for explaining a phase control method in a soft-start period of heaters according to the fifth embodiment.

FIG. 18 is a flowchart for explaining a phase control method in a soft-start period of the heaters according to the fifth embodiment.

First, the CPU 56 determines the start of the soft-start for the completely-off heaters and sets one register value (a register value "a") of the register in the external memory 57 to zero (Step S1801). The CPU 56 sets another register value (a register value "b") of the register in the external memory 57 as the number of repetitions Nr (Step S1802). The CPU 56 calculates an ON width (Step S1803). The ON width is calculated by (first duty Df)+(duty step Ds)×(register value "a"). The CPU 56 controls, with respect to a first half-wave period after the start of the soft-start, the turn-on states of the heaters with the calculated ON width (Step S1804).

Subsequently, the CPU 56 subtracts "1" from the register value "b" (Step S1805) and judges whether the register value "b" after subtracting "1" is zero (Step S1806). When the CPU 56 judges that the register value "b" is not zero ("No" at Step S1806), the CPU 56 returns to Step S1804 and repeats the processing at Step S1804 and subsequent steps for each of half-wave period.

When the CPU 56 judges that the register value "b" is zero ("Yes" at Step S1806), the CPU 56 further judges whether the register value "a" and the set number of steps Ns are the same (Step S1807). When the CPU 56 judges that the register value "a" and the set number of steps Ns are the same ("Yes" at Step S1807), the CPU 56 finishes the soft-start and shifts to the full-on. When the CPU 56 judges that the register value "a" and the set number of steps Ns are not the same ("No" at Step S1807), the CPU 56 adds 1 to the register value "a" (Step S1808). The CPU 56 returns to Step S1802 and repeats the processing at Step S1802 and subsequent steps for each of half-wave periods.

Figure 19:
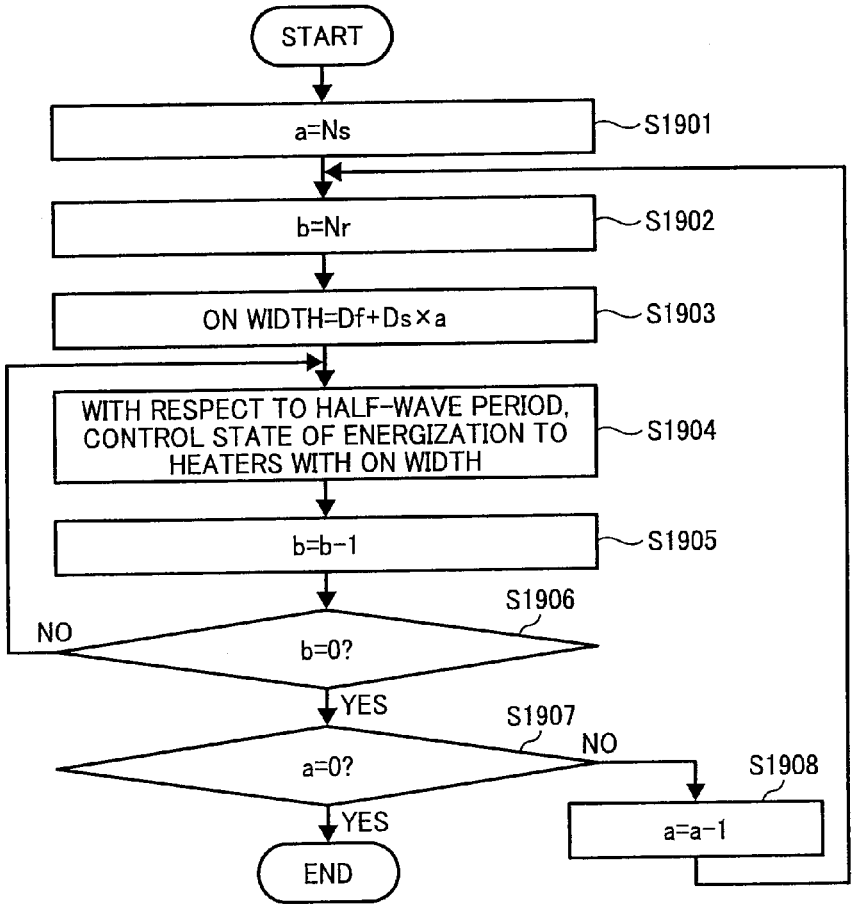
FIG. 19 is a flowchart for explaining a phase control method in a soft-stop period of the heaters according to the fifth embodiment.

FIG. 19 is a flowchart for explaining a phase control method in a soft-stop period of the heaters according to the fifth embodiment.

First, the CPU 56 determines the start of the soft-stop for the fully-on heaters and sets one register value (a register value "a") of the register in the external memory 57 as the number of steps Ns (Step S1901). The CPU 56 sets another register value (a register value "b") of the register in the external memory 57 as the number of repetitions Nr (Step S1902). The CPU 56 calculates an ON width (Step S1903).

The ON width is calculated by (first duty Df)+(duty step Ds)×(register value "a"). The CPU 56 controls, with respect to a first half-wave period after the start of the soft-stop, the turn-on states of the heaters with the calculated ON width (Step S1904).

Subsequently, the CPU 56 subtracts "1" from the register value "b" (Step S1905) and judges whether the register value "b" after subtracting "1" is zero (Step S1906). When the CPU 56 judges that the register value "b" is not zero ("No" at Step S1906), the CPU 56 returns to Step S1904 and repeats the processing at Step S1904 and subsequent steps for each of half-wave period.

When the CPU 56 judges that the register value "b" is zero ("Yes" at Step S1906), the CPU 56 further judges whether the register value "a" is zero (Step S1907). When the CPU 56 judges that the register value "a" is zero ("Yes" at Step S1907), the CPU 56 finishes the soft-stop and shifts to the complete-off. When the CPU 56 judges that the register value "a" is not zero ("No" at Step S1907), the CPU 56 subtracts "1" from the register value "a" (Step S1908). The CPU 56 returns to Step S1902 and repeats the processing at Step S1902 and subsequent steps for each of half-wave periods.

Figure 20:
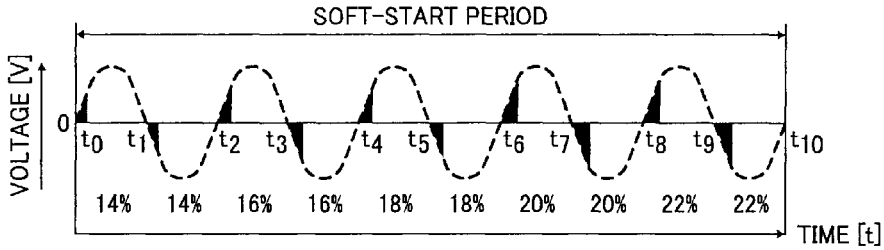
FIG. 20 is a diagram of a waveform of phase control in the soft-start period performed based on parameters according to the fifth embodiment.
Figure 21:
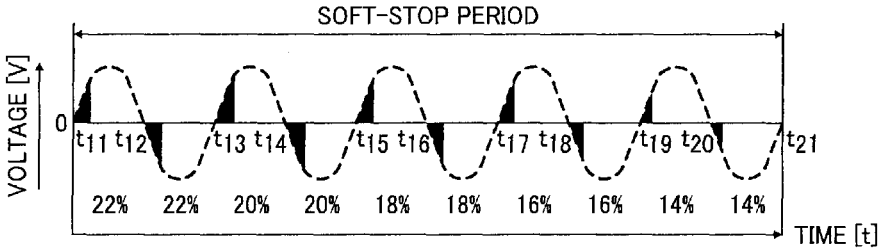
FIG. 21 is a diagram of a waveform of phase control in the soft-stop period performed based on the parameters according to the fifth embodiment.

FIG. 20 is a diagram of a waveform of phase control in the soft-start period performed based on the parameters according to the fifth embodiment. FIG. 21 is a diagram of a waveform of phase control in the soft-stop period performed based on the parameters according to the fifth embodiment. As shown in FIG. 17, it is assumed that a set value of the first duty Df is 14% and a set value of the duty step Ds is 2%. It is assumed that a set value of the number of repetitions Nr is once and a set value of the number of steps Ns is four times.

First, the CPU 56 sets the first duty Df as an ON width in a first half-wave period of a soft-start period ($t_0$ to $t_{10}$) and controls the turn-on states of the heaters ($t_0$ to $t_1$). The CPU 56 executes an operation same as that in the period $t_0$ to $t_1$ for the number of repetitions Nr ($t_1$ to $t_2$).

Subsequently, the CPU 56 calculates values each obtained by adding the duty step Ds to the ON width in the first half-wave period as ON widths until the set value (four times) of the number of steps Ns is reached. The CPU 56 controls the turn-on states of the heaters based on the calculated ON widths. The CPU 56 further controls the turn-on states of the heaters based on the calculated ON widths for the number of repetitions Nr ($t_4$ to $t_{10}$). The CPU 56 records an ON width (22%) of a last half-wave period of the soft-start period in the external memory 57.

The CPU 56 controls, in the soft-start period, the drivers to start applying the voltages at zero-cross time detected by the zero-cross detecting unit 58.

When the soft-start period ends, the CPU 56 shifts to a full-on period in which the heaters are fully on. In the full-on period, a percentage of ON widths in the respective half-wave period is 100%.

When the full-on period ends, the CPU 56 shifts to a soft-stop period ($t_{11}$ to $t_{21}$). The CPU 56 sets the percentage (22%) of the ON width in the last half-wave period of the soft-start period, which is recorded in the external memory 57, or a percentage (22%) of an ON width, which is calculated by totaling the first duty DF (14%) and an integrated value of the duty step Ds (2%) and the number of steps (eight times), as an ON width in a first half-wave period of the soft-stop period and controls the turn-on states of the heaters with the ON width ($t_{11}$ to $t_{12}$). The CPU 56 executes an operation same as that in the period $t_{11}$ to $t_{12}$ for the number of repetitions Nr ($t_{12}$ to $t_{13}$).

Subsequently, the CPU 56 calculates values each obtained by subtracting the duty step Ds from the ON width in the first half-wave period as ON widths until the set value (four times) of the number of steps Ns is reached. The CPU 56 controls the turn-on states of the heaters based on the calculated ON widths. The CPU 56 further controls the turn-on states of the heaters based on the calculated ON widths for the number of repetitions Nr ($t_3$ to $t_{21}$).

When the soft-stop period ends, the heaters are completely turned off. In a complete-off period, a percentage of ON widths in respective half-wave periods is 0%.

As explained above, with the fixing device 50 according to the fifth embodiment, the first duty Df, the duty step Ds, the number of repetitions Nr, and the number of steps Ns are set in the register in the external memory 57 as the parameters for calculating an ON width, ON widths in the respective half-wave periods of the soft-start period and the soft-stop period are calculated based on the parameters, and the turn-on states of the heaters is controlled based on the calculated ON widths. Therefore, it is possible to execute phase control with a higher degree of freedom while reducing a size of the register for calculating an ON width.

With the fixing device 50 according to the fifth embodiment, the first duty Df that defines an ON width in the first half-wave period of the soft-start period is set in the register, an ON width in the first half-wave period is calculated based on the set first duty Df, and the turn-on states of the heaters is controlled based on the calculated ON width. Therefore, even when the zero-cross detecting unit 58 with low zero-cross detection accuracy is used and a zero-cross point deviates, it is possible to control the turn-on states of the heaters with a fixed ON width in the first half-wave period. This makes it possible to turn on the heaters as defined by specifications.

An image forming apparatus 100 according to a sixth embodiment of the present invention is explained. In the explanation of the sixth embodiment, the repetition of the explanation of the image forming apparatus 100 according to the first to fifth embodiments may be omitted.

In the first embodiment, the duty step Ds and the number of steps Ns are set in the register in the external memory 57 as the parameters for calculating an ON width. The ON width is calculated based on the parameters.

On the other hand, in the sixth embodiment, the first duty Df and the number of repetitions Nr are set in the register as the parameters for calculating an ON width. The ON width is calculated based on the parameters.

Figures 22, 23:
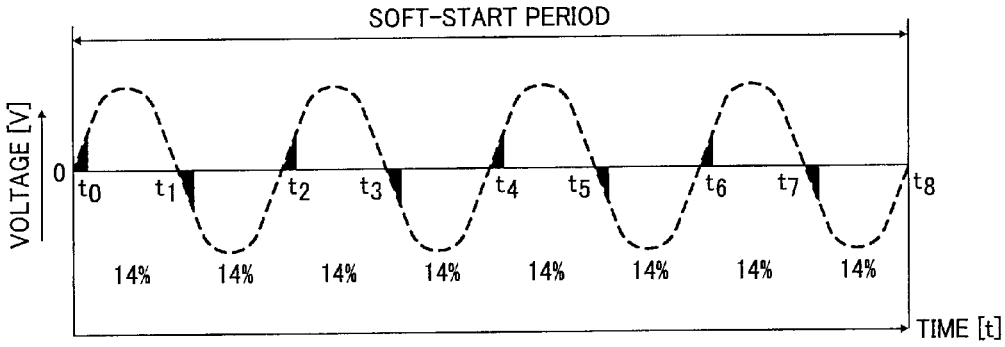
FIG. 22 is a table of register set values of an external memory according to a sixth embodiment of the present invention.
FIG. 23 is a diagram of a waveform of phase control performed based on parameters according to the sixth embodiment.

FIG. 22 is a table of register set values of the external memory 57 according to the sixth embodiment. In the external memory 57 according to the sixth embodiment, as shown in the figure, the power supply frequency Fp, the power supply half-wave Th, the first duty Df, and the number of repetitions Nr are set as parameters.

FIG. 23 is a diagram of a waveform of phase control performed based on the parameters according to the sixth embodiment. As shown in FIG. 22, it is assumed that a set value of the first duty Df is 14% and a set value of the number of repetitions Nr is seven times.

First, the CPU 56 sets the first duty Df as an ON width (14%) in a first half-wave period of a soft-start period ($t_0$ to $t_8$) and controls the turn-on states of the heaters ($t_0$ to $t_1$).

Subsequently, the CPU 56 executes an operation same as that in the period $t_0$ to $t_1$ for the number of repetitions Nr ($t_1$ to $t_8$).

Explanation of a phase control method in a soft-stop period is omitted.

As explained above, with the fixing device 50 according to the sixth embodiment, the first duty Df and the number of repetitions Nr are set in the register in the external memory 57 as parameters, ON widths in the respective half-wave periods of the soft-start period and the soft-stop period are calculated based on the parameters, and the turn-on states of the heaters is controlled based on the calculated ON widths. Therefore, it is possible to execute phase control for an AC voltage while reducing a size of the register for calculating an ON width. Further, even when the zero-cross detecting unit 58 with low zero-cross detection accuracy is used and a zero-cross point deviates, it is possible to control the turn-on states of the heaters with a fixed ON width in the first half-wave period. This makes it possible to turn on the heaters as defined by specifications.

An image forming apparatus 100 according to a seventh embodiment of the present invention is explained. In the explanation of the seventh embodiment, the repetition of the explanation of the image forming apparatus 100 according to the first to sixth embodiments may be omitted.

In the first to sixth embodiments, the soft-start period or the soft-stop period (hereinafter, "phase control period") is decided based on the measured power supply frequency Fp and set values of the power supply half-wave Th, the number of repetitions Nr, and the number of steps Ns obtained by a calculation.

On the other hand, in the seventh embodiment, a phase control period is set in the register in the external memory 57 and phase control is performed in the set period.

In the first to sixth embodiments, the turn-on states of the heaters are uniformly controlled based on a calculated ON width.

On the other hand, in the seventh embodiment, a last duty Dl that defines a threshold of an ON width in a half-wave period is set in the register and, when a calculated ON width exceeds the last duty Dl, the turn-on states of the heaters is controlled based on the last duty Dl.

The last control period and the ON width are deeply related to occurrence of a harmonic current and a flicker (voltage fluctuation). Therefore, if upper limits of the phase control period and the ON width can be set in advance, it is possible to control occurrence of a harmonic current and a flicker.

Figures 24, 25:
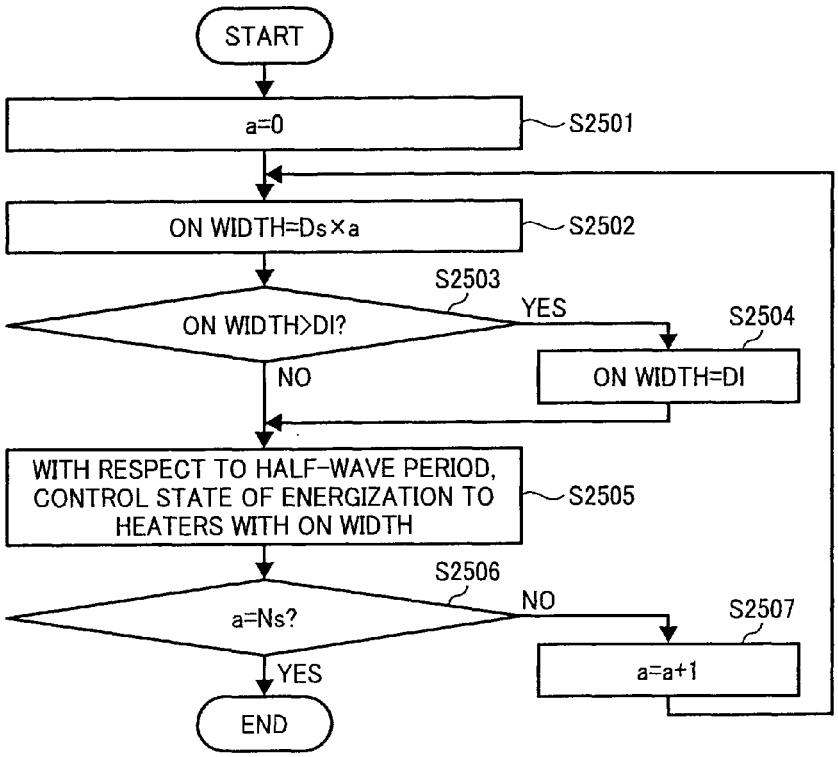
FIG. 24 is a table of register set values of an external memory according to a seventh embodiment of the present invention.
FIG. 25 is a flowchart for explaining a phase control method in a soft-start period of heaters according to the seventh embodiment.

FIG. 24 is a table of register set values of the external memory 57 according to the seventh embodiment.

In the external memory 57 according to the seventh embodiment, as shown in the figure, the power supply frequency Fp, the power supply half-wave Th, a phase control period T, the last duty Dl, the duty step Ds, the number of soft-starts N, and the number of steps Ns are set as parameters.

The power supply frequency Fp defines a frequency of an AC voltage supplied from the AC power supply 53. The power supply half-wave Th defines a period of a half-wave of the AC voltage supplied from the AC power supply 53.

The phase control period T defines the soft-start period or the soft-stop period. The duty step Ds defines an amount of increase in an ON width.

The last duty Dl defines a threshold of an ON width in a half-wave period. When a calculated ON width exceeds the last duty Dl, the CPU 56 controls the turn-on states of the heaters based on the last duty Dl.

The number of soft-starts N defines the number of times the soft-start is performed in the soft-start period. A value of the number of soft-starts N can be calculated by dividing a set value of the phase control period T by a set value of the power supply half-wave Th. By setting the phase control period T and the power supply half-wave Th in the register, the number of soft-starts N is calculated by the CPU 56 and the calculated number of times is set in the register as the number of soft-starts N.

The number of steps Ns defines the number of half-wave periods to which the duty step Ds is added. The number of steps Ns in this embodiment is calculated based on the number of soft-starts N. In this embodiment, it is assumed that the duty step Ds is added to the respective half-wave periods.

FIG. 25 is a flowchart for explaining a phase control method in the soft-start period of the heaters.

First, the CPU 56 determines the start of the soft-start for the completely-off heaters and sets one register value (a register value "a") of the register in the external memory 57 to zero (Step S2501). The CPU 56 calculates an ON width (Step S2502). The ON width is calculated by (duty step Ds)×(register value "a").

Subsequently, the CPU 56 judges whether the calculated ON width is larger than a value of the last duty Dl (Step S2503). When the CPU 56 judges that the calculated ON width is larger than the value of the last duty Dl ("Yes" at Step S2503), the CPU 56 sets an ON width to the value of the last duty Dl (Step S2504). Then, the CPU 56 controls, with respect to a half-wave period, the turn-on states of the heaters with the ON width set to the value of the last duty Dl (Step S2505). When the CPU 56 judges that the calculated ON width is not larger than the value of the last duty Dl ("No" at Step S2503), the CPU 56 directly controls, with respect to the half-wave period, the turn-on states of the heaters with the calculated ON width (Step S2505).

Subsequently, the CPU 56 judges whether the register value "a" and the set number of steps Ns are the same (Step S2506). When the CPU 56 judges that the register value "a" and the set number of steps Ns are the same ("Yes" at Step S2506), the CPU 56 finishes the soft-start and shifts to the full-on. When the CPU 56 judges that the register value "a" and the set number of steps Ns are not the same ("No" at Step S2506), the CPU 56 adds 1 to the register value "a" (Step S2507). The CPU 56 returns to Step S2502 and repeats the processing at Step S2502 and subsequent steps for each of half-wave periods.

Figures 26, 27:
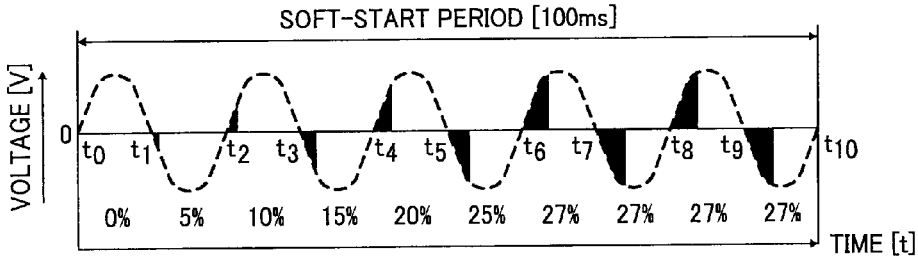
FIG. 26 is a diagram of a waveform of phase control performed based on parameters according to the seventh embodiment.
FIG. 27 is a table of register set values of an external memory according to an eighth embodiment of the present invention.

FIG. 26 is a diagram of a waveform of phase control performed based on the parameters according to the seventh embodiment. As shown in FIG. 24, it is assumed that a set value of the phase control period T is 100 milliseconds, a set value of the last duty Dl is 27%, and a set value of the duty step Ds is 5%. It is assumed that a set value of the power supply half-wave Th is 10 milliseconds.

A value of the number of soft-starts N can be calculated as ten times (phase control period (T: 100 milliseconds)/power supply half-wave (Th: 10 milliseconds)) from the set value of the phase control period T and the set value of the power supply half-wave Th. The number of steps Ns can be calculated as nine times (number of soft-starts (N: ten times)—once) if the duty step Ds is added to the respective half-wave periods.

First, the CPU 56 sets an ON width in a first wave-form period ($t_0$ to $t_1$) of a soft-start period ($t_0$ to $t_{10}$) to 0% and controls the turn-on states of the heaters ($t_0$ to $t_1$).

Subsequently, the CPU 56 calculates a value obtained by adding the duty step Ds to an ON width in a first half-wave period and controls the turn-on states of the heaters based on the calculated ON width (5%) ($t_1$ to $t_2$).

The CPU 56 controls, according to a control method in the period $t_1$ to $t_2$, the turn-on states of the heaters based ON widths each obtained by adding the duty step Ds to the ON width (0%) in the first half-wave period ($t_0$ to $t_1$) ($t_2$ to $t_6$).

When the calculated ON width exceeds the last duty Dl, the CPU 56 controls the turn-on states of the heaters based on the last duty Dl. Calculated respective ON widths in a period $t_6$ to $t_7$ and half-wave periods after the period $t_6$ to $t_7$ are values exceeding the last duty Dl. Therefore, the CPU 56 sets the last duty Dl as ON widths in the period $t_6$ to $t_7$ and the half-wave periods after the period $t_6$ to $t_7$ and controls the turn-on states of the heaters until the set value (nine times) of the number of steps Ns is reached ($t_6$ to $t_{10}$).

Explanation of a phase control method in a soft-stop period is omitted.

In the seventh embodiment, the CPU 56 calculates the number of soft-starts based on the phase control period T and the power supply half-wave Th. However, the CPU 56 can calculate the phase control period T based on the number of soft-starts N and the power supply half-wave Th to set the register.

In the seventh embodiment, the CPU 56 calculates ON widths until the set value of the number of steps Ns is reached. However, the CPU 56 can shift from the soft-start period to the full-on period at a point when a calculated ON width exceeds the last duty Dl.

In the seventh embodiment, the power supply frequency Fp, the power supply half-wave Th, the phase control period T, the last duty Dl, the duty stop Ds, and the number of soft-starts N are set in the register as the parameters. However, the first duty Df and the number of repetitions Nr can be further set in the register and an ON width can be calculated based on the parameters including the first duty Df and the number of repetitions Nr.

As explained above, with the fixing device 50 according to the seventh embodiment, the phase control period T that defines a period in which phase control is performed is set in the register in the external memory 57 as the parameter and, with the set period set as the soft-start period or the soft-stop period, the turn-on states of the heaters is controlled. Therefore, it is possible to execute phase control for an AC voltage while reducing a size of the register for calculating an ON width. Further, it is possible to efficiently realize control of occurrence of a harmonic current and a flicker.

With the fixing device 50 according to the seventh embodiment, the last duty Dl that defines a threshold of an ON width in a half-wave period is set in the register in the external memory 57 as the parameter. Therefore, it is possible to perform phase control based on an ON width that is effective for control of occurrence of a harmonic current and a flicker.

With the fixing device 50 according to the seventh embodiment, the last duty Dl is set in the register in the external memory 57 as the parameter and, when a calculated ON width exceeds the last duty Dl, the turn-on states of the heaters is controlled based on the last duty Dl. Therefore, it is possible to more efficiently realize control of occurrence of a harmonic current and a flicker.

An image forming apparatus 100 according to an eighth embodiment of the present invention is explained. In the explanation of the eighth embodiment, the repetition of the explanation of the image forming apparatus 100 according to the first to seventh embodiments may be omitted.

In the seventh embodiment, an ON width in the first half-wave period is set to 0% to control the turn-on states of the heaters.

On the other hand, in the eighth embodiment, the first duty Df that defines an ON width in a first half-wave period is set in the register and, with the first duty Df set as an ON width in the first half-wave period, the turn-on states of the heaters is controlled.

FIG. 27 is a diagram of register set values of the external memory 57 according to the eighth embodiment. In the external memory 57 according to the eighth embodiment, as shown in the figure, the power supply frequency Fp, the power supply half-wave Th, the phase control period T, the last duty Dl, the first duty Df, the duty stop Ds, the number of soft-starts N, and the number of steps Ns are set as parameters.

The first duty Df defines an ON width in a first half-wave period of a soft-start period.

Figure 28:
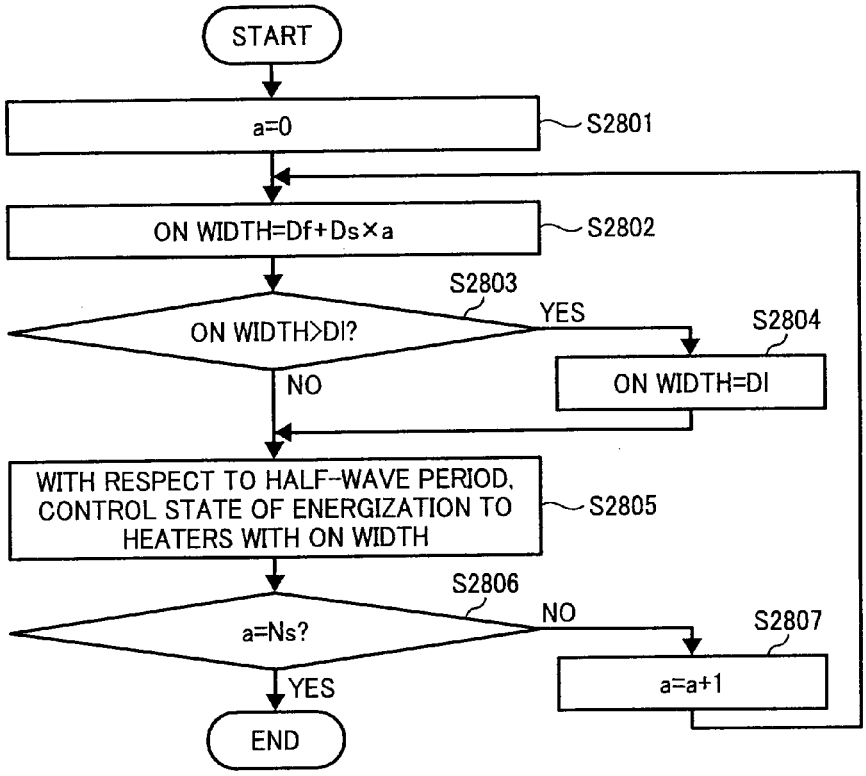
FIG. 28 is a flowchart for explaining a phase control method in a soft-start period of heaters according to the eighth embodiment.

FIG. 28 is a flowchart for explaining a phase control method in the soft-start period of the heaters according to the eighth embodiment.

First, the CPU 56 determines the start of the soft-start for the completely-off heaters and sets one register value (a register value "a") of the register in the external memory 57 to zero (Step S2801). The CPU 56 calculates an ON width (Step S2802). The ON width is calculated by (first duty Df)+(duty stop Ds)×(register value "a").

Subsequently, the CPU 56 judges whether the calculated ON width is larger than a value of the last duty Dl (Step S2803). When the CPU 56 judges that the calculated ON width is larger than the value of the last duty Dl ("Yes" at Step S2803), the CPU 56 sets an ON width to the value of the last duty Dl (Step S2804). Thereafter, the CPU 56 controls, with respect to a half-wave period, the turn-on states of the heaters with the ON width set to the value of the last duty dl (Step S2805). When the CPU 56 judges that the calculated ON width is not larger than the value of the last duty Dl ("No" at Step S2803), the CPU 56 directly controls, with respect to the half-wave period, the turn-on states of the heaters with the calculated ON width (Step S2805).

The CPU 56 judges whether the register value "a" and the set number of steps Ns are the same (Step S2806). When the CPU 56 judges that the register value "a" and the set number of steps Ns are the same ("Yes" at Step S2806), the CPU 56 finishes the soft-start and shifts to the full-on. When the CPU 56 judges that the register value "a" and the set number of steps Ns are not the same ("No" at Step S2806), the CPU 56 adds 1 to the register value "a" (Step S2807). The CPU 56 returns to Step S2802 and repeats the processing at Step S2802 and subsequent steps for each of half-wave periods.

Figure 29:
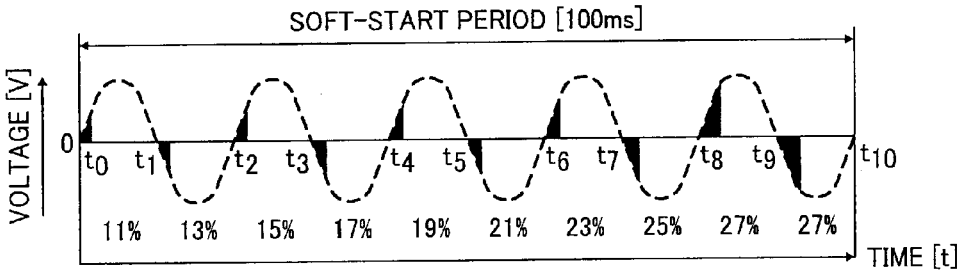
FIG. 29 is a diagram of a waveform of phase control performed based on parameters according to the eighth embodiment.

FIG. 29 is a diagram of a waveform of phase control performed based on the parameters according to the eighth embodiment. As shown in FIG. 27, it is assumed that a set value of the phase control period T is 100 milliseconds and a set value of the last duty Dl is 27%. It is assumed that a set value of the first duty Df is 11% and a set value of the duty stop Ds is 2%.

The number of soft-starts N can be calculated as ten times by the calculation method explained in the seventh embodiment. The number of steps Ns can be calculated as nine times by the calculation method explained in the seventh embodiment.

First, the CPU 56 sets the first duty DF as an ON width (11%) in a first half-wave period ($t_0$ to $t_1$) of a soft-start period ($t_0$ to $t_{10}$) and controls the turn-on states of the heaters ($t_0$ to $t_1$).

Subsequently, the CPU 56 calculates a value obtained by adding the duty step Ds to the ON width in the first half-wave period as an ON width and controls the turn-on states of the heaters based on the calculated ON width (13%) ($t_0$ to $t_2$).

The CPU 56 calculates values each obtained by adding the duty step Ds to the ON width (11%) in the first half-wave period ($t_0$ to $t_1$) as ON widths and controls the turn-on states of the heaters based on the calculated ON width ($t_0$ to $t_9$).

When the ON width calculated by adding the duty step Ds exceeds the last duty Dl, the CPU 56 controls the turn-on states of the heaters based on the last duty Dl. The calculated ON width in the half-wave period in the period $t_8$ to $t_9$ exceeds the last duty Dl. Therefore, the CPU 56 sets the last duty Dl as ON widths in the period t8 to t9 and half-wave periods after the period t8 to t9 and controls the turn-on states of the heaters until the set value (nine times) of the number of steps Ns is reached ($t_8$ to $t_{10}$).

Explanation of a phase control method in a soft-stop period is omitted.

As explained above, with the fixing device 50 according to the eighth embodiment, a set value of the first duty Df that defines an ON width in the first half-wave period of the soft-start period is set in the register and, with the set first duty Df set as an ON width in the first half-wave period, the turn-on states of the heaters is controlled. Therefore, even when the zero-cross detecting unit 58 with low zero-cross detection accuracy is used and a zero-cross point deviates, it is possible to control the turn-on states of the heaters with a fixed ON width in the first half-wave period. This makes it possible to turn on the heaters as defined by specifications.

With the fixing device 50 according to the eighth embodiment, the phase control period T that defines a period in which phase control is performed is set in the register in the external memory 57 as the parameter and, with the set period set as the soft-start period or the soft-stop period, the turn-on states of the heaters is controlled. Therefore, it is possible to efficiently realize control of occurrence of a harmonic current and a flicker.

An image forming apparatus 100 according to a ninth embodiment of the present invention is explained. In the explanation of the ninth embodiment, the repetition of the explanation of the image forming apparatus 100 according to the first to eighth embodiments may be omitted.

In the seventh and eighth embodiments, the duty step Ds is set in the register in the external memory 57 as the parameter and values each obtained by adding the duty step Ds to the ON width in the first half-wave period are calculated as ON widths.

On the other hand, in the ninth embodiment, the duty step Ds is calculated based on respective parameters and values each obtained by adding the calculated duty step Ds to the ON width in the first half-wave period are calculated as ON widths.

Figures 30, 31:
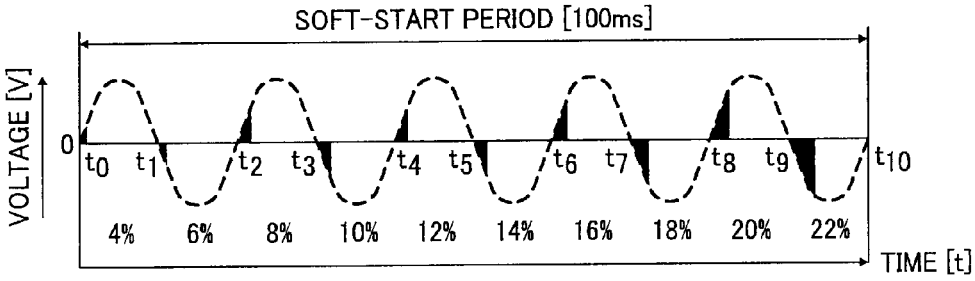
FIG. 30 is a table of register set values of an external memory according to a ninth embodiment of the present invention.
FIG. 31 is a diagram of a waveform of phase control performed based on parameters according to the ninth embodiment.

FIG. 30 is a table of register set values of the external memory 57 according to the ninth embodiment.

In the external memory 57 according to the ninth embodiment, as shown in the figure, the power supply frequency Fp, the power supply half-wave Th, the phase control period T, the last duty Dl, the first duty Df, the number of soft-starts N, and the number of steps Ns are set as parameters.

The duty step Ds defines an amount of increase in an ON width. The duty step Ds in this embodiment is an amount of increase in an ON width with which ON widths calculated by adding the duty step Ds increase linearly. The duty step Ds is calculated based on respective set values of the phase control period T, the last duty Dl, and the first duty Df.

An equation for calculating the duty step Ds can be any equation as long as an amount of increase in an ON width with which ON widths in respective half-wave periods increase linearly can be calculated.

For example, as shown in FIG. 30, when a set value of the last duty Dl is 22%, a set value of the first duty Df is 4%, and the number of steps can be calculated as nine times by the method described above, an amount of increase in an ON width can be calculated as 2% from the following equation:

$$Ds=\{(D1:22\%)-(Df:4\%)\}/(Ds\text{: nine times})$$

FIG. 31 is a diagram of a waveform of phase control performed based on the parameters according to the ninth embodiment. As shown in FIG. 30, it is assumed that a set value of the phase control period T is 100 milliseconds. It is assumed that a set value of the last duty Dl is 22% and a set value of the first duty Df is 4%.

It is assumed that a value of the number of steps Ns is nine times from the calculation method explained in the seventh embodiment. It is assumed that a calculated value of the duty step Ds is 2% according to the calculation method.

First, the CPU 56 sets the first duty Df as an ON width (4%) in a first half-wave period ($t_0$ to $t_1$) of a soft-start period ($t_0$ to $t_{10}$) and controls the turn-on states of the heaters ($t_0$ to $t_1$).

Subsequently, the CPU 56 calculates a value obtained by adding the duty step Ds to the ON width in the first half-wave period as an ON width and controls the turn-on states of the heaters based on the calculated ON width (6%) ($t_1$ to $t_2$).

The CPU 56 calculates, according to a control method in the period $t_1$ to $t_2$, ON width in respective half-wave periods until the set value (nine times) of the number of steps Ns is reached and controls the turn-on states of the heaters ($t_2$ to $t_{10}$).

Explanation of a phase control method in a soft-stop period is omitted.

In the ninth embodiment, it is also possible that a threshold of the number of steps Ns is set in the register and the duty step Ds is calculated in a range not exceeding the threshold. By providing the threshold of the number of steps Ns, it is possible to limit the number of half-wave periods to which the duty step Ds is added and make an extremely large calculation digit unnecessary.

In the ninth embodiment, the duty step Ds is calculated based on the last duty Dl, the first duty Df, and the number of steps Ns. However, the duty step Ds can be calculated based on the parameters including the number of repetitions Nr.

As explained above, with the fixing device 50 according to the ninth embodiment, the number of steps Ns and the duty step Ds, which is a linear amount of increase in an ON width, are calculated based on the respective parameters, respective values obtained by adding the calculated duty step Ds to the ON width in the first half-wave period by the number of steps Ns are calculated as ON widths, and the turn-on states of the heaters is controlled based on the calculated ON widths. Therefore, it is possible to efficiently realize control of occurrence of a harmonic current and a flicker.

An image forming apparatus 100 according to a tenth embodiment of the present invention is explained. In the explanation of the tenth embodiment, the repetition of the explanation of the image forming apparatus 100 according to the first to ninth embodiments may be omitted.

In the first to ninth embodiments, the CPU 56 controls, during the soft-start period and the soft-stop period, the drivers to start applying the voltages by the drivers at the zero-cross time in the respective half-wave periods of the AC power detected by the zero-cross detecting unit 58 and, when a calculated ON width ends, finish applying the voltages by the drivers.

On the other hand, in the tenth embodiment, the CPU 56 controls, during the soft-start period and the soft-stop period, the drivers to start applying the voltages by the drivers after fixed time elapses from the zero-cross time in the respective half-wave periods of the AC power detected by the zero-cross detecting unit 58 and, when a calculated ON width ends, finish applying the voltages by the drivers.

FIG. 32 is a table of register set values of the external memory 57 according to the tenth embodiment.

In the external memory 57 according to the tenth embodiment, as shown in the figure, the power supply frequency Fp, the power supply half-wave Th, the duty step Ds, the number of steps Ns, and turn-on start time Ts are set.

The turn-on start time Ts defines after how long time elapses from zero-cross time detected by the zero-cross detecting unit 58 applying the voltages by the drivers is started. In this embodiment, the power supply wavelength Th is set to 10 milliseconds and the turn-on start time Ts is set to 5 milliseconds.

FIG. 33 is a diagram of a waveform of phase control in a soft-start period of the heaters performed based on the parameters according to the tenth embodiment. FIG. 34 is a diagram of a waveform of phase control in a soft-stop period of the heaters performed based on the parameters according to the tenth embodiment. In both the cases, an ON width is 25%. It is seen from the figure that, in both the soft-start period and the soft-stop period, applying the voltages is started after 5 milliseconds from zero-cross time of the power supply half-wave Th.

The turn-on start time Ts can be arbitrarily set. Therefore, for example, in the soft-stop period, if the turn-on start time Ts is set to finish applying the voltages to the heaters when respective half-wave periods end, in the shift from the full-on period to the soft-stop period, it is possible to provide an extinguishing period of the heaters and smoothly start phase control in the soft-stop period. Therefore, it is possible to obtain effects same as those of the image forming apparatus according to the second embodiment.

When a value obtained by adding the ON width to the turn-on start time Ts exceeds the power supply half-wave Th, applying the voltages by the drivers can be finished at a point when the power supply half-wave Th ends. Alternatively, applying the voltages by the drivers can be finished after applying the voltages is continuously performed until the next power supply half-wave Th and the ON width ends.

As explained above, with the fixing device 50 according to the tenth embodiment, in the soft-start period and the soft-stop period, the turn-on start time of the drivers is controlled by the CPU 56 to make it possible to apply the voltages to the heaters at arbitrary timing in a half-wave period. Therefore, it is possible to flexibly perform phase control in the soft-start period and the soft-stop period.

As described above, according to an aspect of the present invention, parameters for calculating ON widths in respective half-wave periods of AC power are stored in the storing means, ON width in the respective half-wave periods are calculated based on the parameters, and phase control for the AC power is executed on the heating means. Therefore, there is an effect that it is possible to execute the phase control for the AC power while reducing a memory capacity.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

a heating unit that is heated by supply of an alternate-current power;

a heating control unit that executes a phase control to supply the alternate-current power to the heating unit for an ON-width in at least a half-wave period of the alternate-current power; and a storing unit that stores therein parameters for calculating the ON width and a duty step that defines an amount of increase or decrease in the ON width, wherein the heating control unit calculates the ON width based on the parameters and the duty step stored in the storing unit and executes the phase control using a calculated ON width, wherein the heat control unit calculates the ON width based on the duty step that defines an amount of increase in the ON width in case of a soft-start period, and the heat control unit calculates the ON width based on the duty step that defines an amount of decrease in the ON width in case of a soft-end period, wherein the parameters include:

the duty step that defines an amount of increase in the ON width, and a phase control period that defines a period during which the phase control is executed, and the heating control unit calculates a number of half-wave periods for which the duty step is added based on the phase control period and the half-wave period, and calculates the ON width based on the calculated number of half-wave periods and the duty step.

2. The fixing device according to claim 1, wherein the parameters further include a last duty that defines a threshold of the ON width, and when the calculated ON width exceeds the last duty, the heating control unit executes the phase control using the last duty.

3. The fixing device according to claim 1, wherein the parameters further include a first duty that defines an ON width in a first half-wave period.

4. The fixing device according to claim 2, wherein the parameters further include a first duty that defines an ON width in a first half-wave period.

5. An image forming apparatus comprising:

a fixing device for fixing a toner image on a recording medium, the fixing device including:

a heating unit that is heated by supply of an alternate-current power, a heating control unit that executes a phase control to supply the alternate-current power to the heating unit for an ON-width in at least a half-wave period of the alternate-current power, and a storing unit that stores parameters for calculating the ON width and a duty step that defines an amount of increase or decrease in the ON width, wherein the parameters include:

the duty step that defines an amount of increase in the ON width, and a phase control period that defines a period during which the phase control is executed, the heating control unit calculates a number of half-wave periods for which the duty step is added based on the phase control period and the half-wave period, and calculates the ON width based on the calculated number of half-wave periods and the duty step the heating control unit executes the phase control using the calculated ON width, the heat control unit calculates the ON width based on the duty step that defines an amount of increase in the ON width in case of a soft-start period, and the heat control unit calculates the ON width based on the duty step that defines an amount of decrease in the ON width in case of a soft-end period.

6. A heating control method performed in a fixing device, the heating control method comprising:

heating a heating unit by supplying an alternate-current power;

executing, by a heat control unit, a phase control to supply the alternate-current power to the heating unit for an ON-width in at least a half-wave period of the alternate-current power storing parameters for calculating the ON width and a duty step that defines an amount of increase or decrease in the ON width wherein the parameters include:

the duty step that defines an amount of increase in the ON width, and a phase control period that defines a period during which the phase control is executed, and the executing includes:

calculating a number of half-wave periods for which the duty step is added based on the phase control period and the half-wave period, calculating the ON width based on the calculated number of half-wave periods and the duty step, and executing the phase control using a calculated ON width, wherein the heat control unit calculates the ON width based on the duty step that defines an amount of increase in the ON width in case of a soft-start period, and the heat control unit calculates the ON width based on the duty step that defines an amount of decrease in the ON width in case of a soft-end period.

* * * * *